US012246210B2

(12) United States Patent
Tighe et al.

(10) Patent No.: US 12,246,210 B2
(45) Date of Patent: Mar. 11, 2025

(54) MONOLIFT RACK ASSEMBLY

(71) Applicant: Coulter Ventures, LLC., Columbus, OH (US)

(72) Inventors: Charlie Tighe, Columbus, OH (US); Ahmik Jones, Upper Arlington, OH (US); Tyler McClure, Galena, OH (US); Donnell Carrington, III, Columbus, OH (US); Martin Pritchett, Columbus, OH (US); Nash Dunahay, Blacklick, OH (US)

(73) Assignee: Coulter Ventures, LLC., Columbus, OH (US)

( * ) Notice: Subject to any disclaimer, the term of this patent is extended or adjusted under 35 U.S.C. 154(b) by 146 days.

(21) Appl. No.: 17/955,164

(22) Filed: Sep. 28, 2022

(65) Prior Publication Data

US 2023/0099317 A1 Mar. 30, 2023

Related U.S. Application Data

(60) Provisional application No. 63/249,390, filed on Sep. 28, 2021.

(51) Int. Cl.
*A63B 21/078* (2006.01)
*A47B 81/00* (2006.01)

(52) U.S. Cl.
CPC ..... *A63B 21/078* (2013.01); *A47B 81/005* (2013.01)

(58) Field of Classification Search
CPC ... A63B 21/078; A63B 17/04; A63B 71/0036; A63B 21/0783; A63B 21/0724; A63B 2225/093; A47B 81/005; A47B 47/02; A47B 57/485
See application file for complete search history.

(56) References Cited

U.S. PATENT DOCUMENTS

| | | | | |
|---|---|---|---|---|
| 9,597,539 | B2 * | 3/2017 | Grider | A63B 21/00047 |
| 11,759,670 | B2 * | 9/2023 | Hsu | A63B 71/0036 482/104 |
| 2014/0296040 | A1 * | 10/2014 | Mobley | A63B 21/00181 482/104 |
| 2016/0101310 | A1 * | 4/2016 | Staten | A63B 23/0405 482/98 |
| 2019/0247701 | A1 | 8/2019 | Sergakis et al. | |
| 2019/0275363 | A1 * | 9/2019 | Jones | A63B 21/16 |
| 2020/0038704 | A1 | 2/2020 | Adams | |
| 2020/0164242 | A1 * | 5/2020 | Grissel, Jr. | A63B 21/078 |

OTHER PUBLICATIONS https://web.archive.org/web/20210917152225/https://mutantmetals.com/products/p/mutant-metals-snap-roller-monos; Date: Sep. 17, 2021 (Year: 2021).*

(Continued)

*Primary Examiner* — Megan Anderson
*Assistant Examiner* — Andrew M Kobylarz
(74) *Attorney, Agent, or Firm* — Banner & Witcoff, Ltd.

(57) ABSTRACT

A monolift assembly includes a carriage assembly configured to be releasably secured to a post of a rack for weightlifting equipment. A pivoting piece is pivotally connected to the carriage assembly and has a hook at a first end thereof and a counterweight at a second end thereof. The pivoting piece includes a central plate, a first exterior plate abutting a first side of the central plate and a second exterior plate abutting a second side of the central plate.

27 Claims, 22 Drawing Sheets

(56) References Cited

OTHER PUBLICATIONS

Feb. 22, 2023—(WO) ISR and WO—App PCT/US2022/077187.
Rogue Adjustable Monolift—Monster Lite; From: https://www.roguefitness.com/rogue-adjustable-monolift-monster-lite; dated Jun. 27, 2015, accessed Oct. 1, 2021.
Rogue Monster Lite/Infinity Monolift Attachment ; From:https://www.roguefitness.com/rogue-monster-lite-monolift-attachment; dated Aug. 9, 2020, accessed Oct. 1, 2021.
Rogue Adjustable Monolift—Monster; From: https://www.roguefitness.com/rogue-adjustable-monolift-monster; dated Aug. 9, 2015, accessed Oct. 1, 2021.
Apr. 11, 2024—(WO) IPRP—App PCT/US2022/077187.

* cited by examiner

MONOLIFT RACK ASSEMBLY

CROSS-REFERENCE TO RELATED APPLICATIONS

This application claims benefit to U.S. Provisional Application No. 63/249,390 titled "Monolift Rack Assembly" and filed on Sep. 28, 2021, which is incorporated herein by reference in its entirety. This application also incorporates the following application by reference in its entirety: United States Design Application No. 29/808,254, titled "Weightlifting Implement" and filed on Sep. 17, 2021.

FIELD

Aspects of this disclosure relate generally to a monolift rack assembly, and, more particularly, to a monolift rack assembly having a pivoting piece formed of multiple plates.

BACKGROUND

Individuals often exercise or train with weights to develop strength and endurance and improve their cardiovascular health. Users may perform squats using weights on a barbell seated on hooks on a rack. In some monolift assemblies, the hooks are fixed with respect to the rack, and in use the user lifts the barbell and walks out away from the rack before performing squat lifts.

In other monolift assemblies, pivoting pieces with hooks at one end and counterweights at the other end may be pivotally secured to the rack, and a barbell with weights may be seated on and removed from the hooks. In use, when the user lifts the barbell, the counterweights cause the pivoting pieces to swing away from the barbell, allowing the user to perform squat lifts.

It would be desirable to provide a monolift assembly that reduces or overcomes some or all of the difficulties inherent in prior known devices. Particular objects and advantages will be apparent to those skilled in the art, that is, those who are knowledgeable or experienced in this field of technology, in view of the following disclosure and detailed description of certain embodiments.

SUMMARY

In accordance with a first aspect, a monolift assembly includes a carriage assembly configured to be releasably secured to a post of a rack for weightlifting equipment. A pivoting piece is pivotally connected to the carriage assembly and has a hook at a first end thereof and a counterweight at a second end thereof. The pivoting piece includes a central plate, a first exterior plate abutting a first side of the central plate and a second plate abutting a second side of the central plate.

These and additional features and advantages disclosed here will be further understood from the following detailed disclosure of certain embodiments, the drawings thereof, and from the claims.

BRIEF DESCRIPTION OF THE DRAWINGS

The foregoing and other features and advantages of the present embodiments will be more fully understood from the following detailed description of illustrative embodiments taken in conjunction with the accompanying drawings in which.

Figure 1:
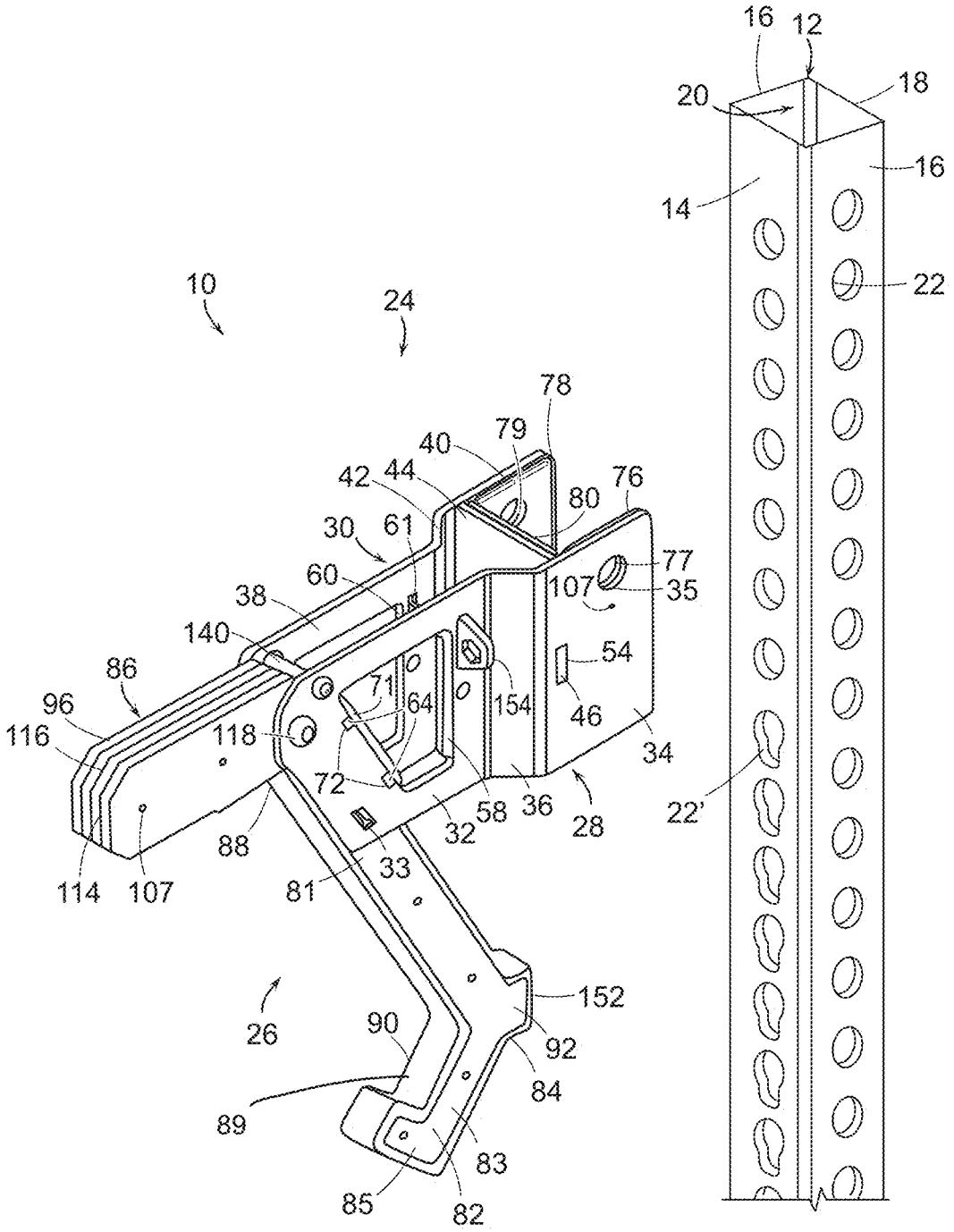
FIG. 1 is a perspective view, in exploded form, of a monolift assembly and a post of a weightlifting rack according to aspects of the disclosure.

The figures referred to above should be understood to provide a representation of particular embodiments The same reference numbers are used in the drawings for similar or identical components and features shown in various alternative embodiments. Monolift assemblies as disclosed herein would have configurations and components determined, in part, by the intended application and environment in which they are used.

DETAILED DESCRIPTION OF EMBODIMENTS

In the following description of various example structures in accordance with the disclosure, reference is made to the accompanying drawings, which form a part hereof, and in which are shown by way of illustration of various structures in accordance with the disclosure. Additionally, it is to be understood that other specific arrangements of parts and structures may be utilized, and structural and functional modifications may be made without departing from the scope of the present disclosure. Also, while spatial terms such as "top", "bottom", rear, front, vertical, and the like may be used in this specification to describe various example features and elements of the disclosure, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this disclosure.

The term "approximately" as used herein is meant to mean close to, or about a particular value, within the constraints of sensible commercial engineering objectives, costs, manufacturing tolerances, and capabilities in the field of monolift rack assembly manufacturing and use. Similarly, the term "substantially" as used herein is meant to mean mostly, or almost the same as, within the constraints of sensible commercial engineering objectives, costs, manufacturing tolerances, and capabilities in the field of monolift rack assembly manufacturing and use.

Figure 2:
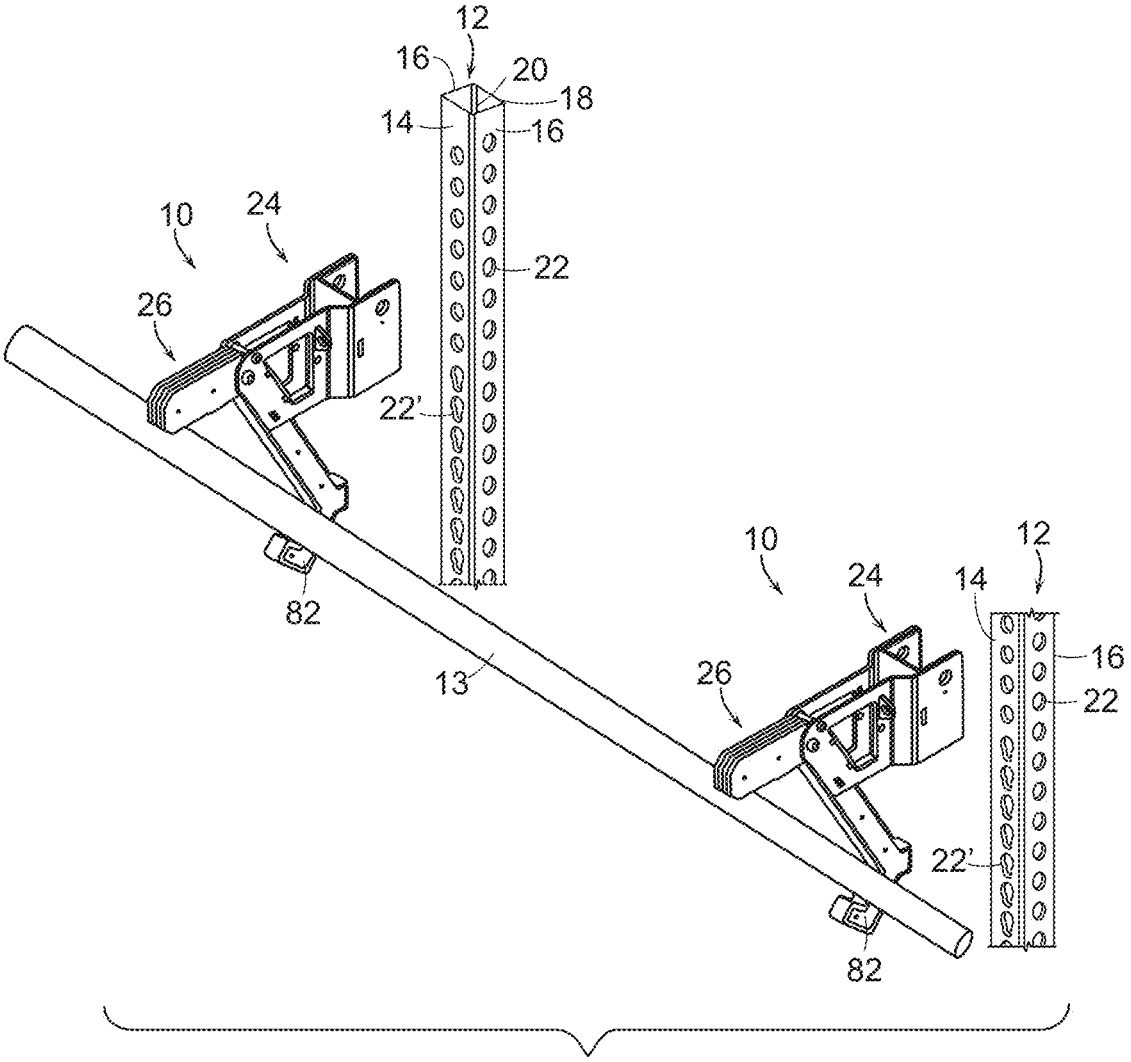
FIG. 2 is a perspective view, in exploded form, of a pair of monolift assemblies in use with a barbell, and a post of a weightlifting rack according to aspects of the disclosure

Referring to FIGS. 1-4, a monolift assembly 10 is shown adjacent a vertically extending post 12 of a weightlifting assembly. Monolift assembly 10 is configured to be removably attached to post 12 as described in greater detail below. A pair of monolift assemblies 10 may be used, in one example, with a barbell 13 for weightlifting exercises, as seen in FIG. 2 and described in greater detail below.

Post 12 may be a hollow bar formed of a front wall 14, a pair of opposed sidewalls 16, and a rear wall 18, surrounding and defining an interior cavity 20. In certain embodiments, posts 12 may have a substantially rectangular cross-section. Post 12 may include a plurality of post apertures 22 formed in one or more of front wall 14, sidewalls 16, and rear wall 18. In certain embodiments, one or more post apertures 22' may be keyhole shaped. Post 12 may be formed of metal, such as steel, for example. Other suitable materials for post 12 will become readily apparent to those skilled in the art, given the benefit of this disclosure.

Monolift assembly 10 may include a carriage assembly 24 and a pivoting piece 26 pivotally secured to carriage assembly 24. Unless otherwise noted herein, carriage assembly 24 and pivoting piece 26 may be at least partially formed of metal, such as steel. Other suitable materials for carriage assembly 24 and pivoting piece 26, or portions thereof, will become readily apparent to those skilled in the art, given the benefit of this disclosure.

Carriage assembly 24 may be formed of a first carriage plate 28 and a second carriage plate 30 spaced from first carriage plate 28. First carriage plate 28 may be formed of a first leg portion 32, a first arm portion 34, and a first connecting portion 36 extending between first leg portion 32 and first arm portion 34. A first key slot 33 may be formed in and extend through first leg portion 32. A first arm aperture 35 may extend through first arm portion 34.

Second carriage plate 30 may be formed of a second leg portion 38, a second arm portion 40, and a second connecting portion 42 extending between second leg portion 38 and second arm portion 40. A second arm aperture 41 may extend through second arm portion 40. A second key slot 39 may be formed in and extend through second leg portion 38.

First connecting portion 36 may extend outwardly at an angle from first leg portion 32 to first arm portion 34, and second connecting portion 42 may extend outwardly at an angle from second leg portion 38 to second arm portion 40 such that first arm portion 34 and second arm portion 40 are spaced from one another a greater distance than first leg portion 32 and second leg portion 38 are spaced from one another. This configuration provides carriage assembly 24 with a substantially Y shaped profile, with first and second arm portions 34, 40 forming the arms of the Y shape that are configured to receive post 12 when carriage assembly 26 is secured to post 12.

An arm connecting plate 44 may extend between first arm portion 34 and second arm portion 40 and serve to keep first arm portion 34 and second arm portion 40 spaced from one another, and provide rigidity for carriage assembly 24. As seen best in FIGS. 3-4, a first arm tab 46 may extend outwardly from a first edge 48 of arm connecting plate 44, and a second arm tab 50 may extend outwardly from an opposed second edge 52 of arm connecting plate 44. An arm connecting plate aperture 51 may extend through arm connecting plate 44.

A first arm tab aperture 54 may be formed in first arm portion 34 and may receive first arm tab 46. A second arm tab aperture 56 may be formed in second arm portion 40 and may receive second arm tab 50.

First leg portion 32 may include a first through-aperture 58, and second leg portion 38 may include a second through-aperture 60, each of which may serve to reduce the weight of carriage assembly 24. First leg portion 32 may include a first key storage slot 59 extending therethrough, and second leg portion 38 may include a second key storage slot 61 extending therethrough.

A leg connecting plate 62 may extend between first leg portion 32 and second leg portion 38 and serve to keep first leg portion 32 and second leg portion 38 spaced from one another, and provide rigidity for carriage assembly 24. Together, arm connecting plate 44 and leg connecting plate 62 extend between and transverse to the carriage plates 28, 30, to space the carriage plates 28, 30 from each other and connect the carriage plates 28, 30. A pair of first leg tabs 64 may extend outwardly from a first edge 66 of leg connecting plate 62, and a pair of second leg tabs 68 may extend outwardly from an opposed second edge 70 of leg connecting plate 62. A leg pad 71 may be secured to an interior surface of leg connecting plate 62. Leg pad 71 may be formed of a plastic or other polymer material, such as rubber or a hard plastic or composite material, and may serve as a comfortable surface for a user to grasp when securing carriage assembly 24 to and removing it from post 12. Other suitable materials for leg pad 71 will become readily apparent to those skilled in the art, given the benefit of this disclosure.

A pair of first tab recesses 72 may be formed in first leg portion 32 along a periphery of first through-aperture 58 and may receive first leg tabs 64. A pair of second tab recesses 74 may be formed in second leg portion 38 along a periphery of second through-aperture 60 and may receive second leg tabs 68.

A first arm pad 76 may be secured to an interior surface of first arm portion 34, and a second arm pad 78 may be secured to an interior surface of second arm portion 40 and face first arm pad 76. An arm connecting plate pad 80 may be secured to an interior surface of arm connecting plate 44. A first arm pad aperture 77 may be formed in and extend through first arm pad 76. A second arm pad aperture 79 may be formed in and extend through second arm pad 78. An arm connecting plate pad aperture 75 may be formed in and extend through arm connecting plate pad 80.

Figure 7:
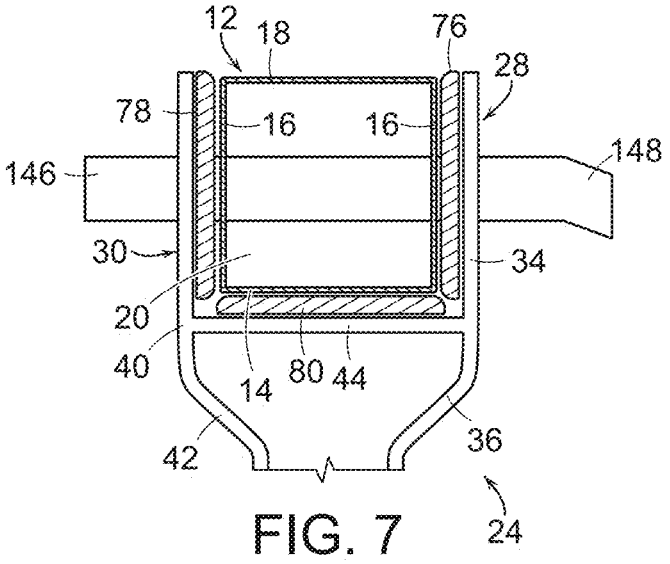
FIG. 7 is a plan view of a portion of a carriage assembly of the monolift assembly of FIG. 1, shown secured to the post of FIG. 1.
Figure 8:
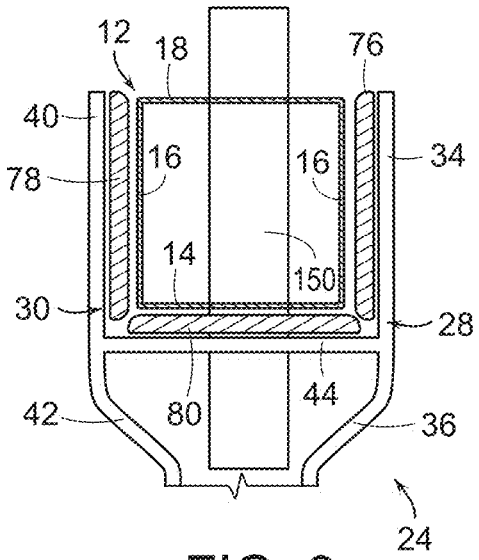
FIG. 8 is another plan view of a portion of a carriage assembly of the monolift assembly of FIG. 1, shown secured to the post of FIG. 1.

First arm pad 76 and second arm pad 78 are configured to abut sidewalls 16 of post 12, and arm connecting plate pad 80 is configured to abut front wall 14 of post 12 when carriage assembly 24 is secured to post 12, as seen in FIGS. 7-8. First arm pad 76, second arm pad 78, and arm connecting plate pad 80 may be formed of a hard plastic or composite material in one embodiment, which serves to reduce damage to components caused by metal-on-metal interaction with post 12, as well as potentially reducing noise when carriage assembly 24 is secured to post 12.

Pivoting piece 26 may include a central portion 81, and a hook 82 formed at a first end 84 of central portion 81. As seen in FIG. 2, hook 82 may be configured such that barbell 13 with attached weights (not shown) can be seated and retained on pivoting piece 26 when not in use. The use of barbell 13 with weights is described in greater detail below.

Figure 9:
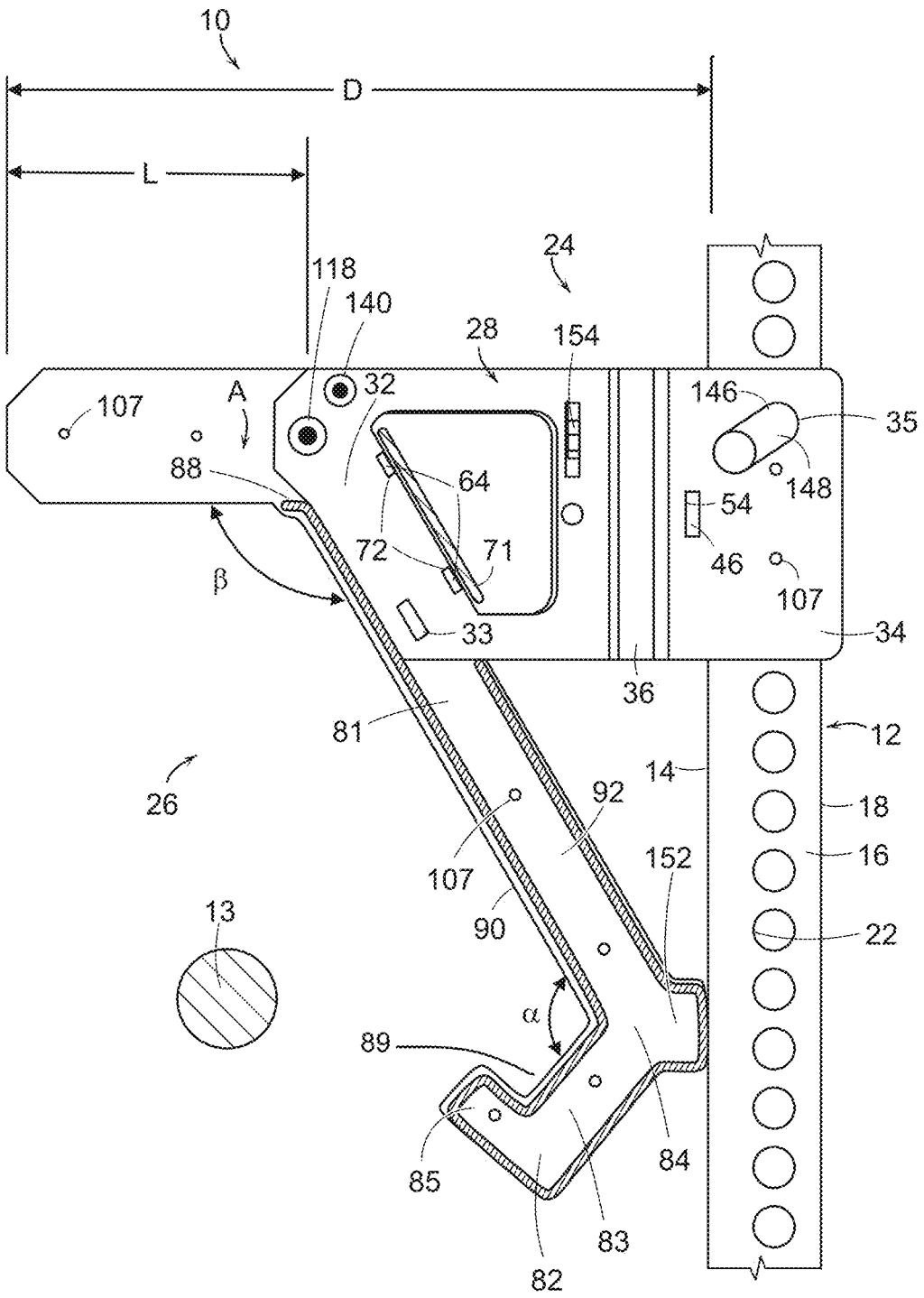
FIG. 9 is an elevation view of the monolift assembly of FIG. 1 secured to the post of FIG. 1, shown with a barbell spaced from the monolift assembly.

Hook 82 may be formed of a leg 83 at first end 84 of central portion 81 and a protrusion 85 extending upwardly from leg 83 that cooperate to provide a substantially J-shaped end of pivoting piece 26. Central portion 81, leg 83, and protrusion 85 define a notch 89 in hook 82 that is configured to receive a barbell 13 or other weightlifting article. In certain embodiments, protrusion 85 may extend substantially perpendicular to leg 83. As seen in FIG. 9, leg 83 may extend outwardly from central portion 81 at an angle $\alpha$. In certain embodiments, angle $\alpha$ may be between approximately 90° and approximately 120°.

A counterweight 86 may be formed at a second end 88 of central portion 81. As seen in Counterweight 86 may extend outwardly from central portion 81 at an angle $\beta$. In certain embodiments, angle $\beta$ may be between approximately 100° and approximately 130°.

Figure 5:
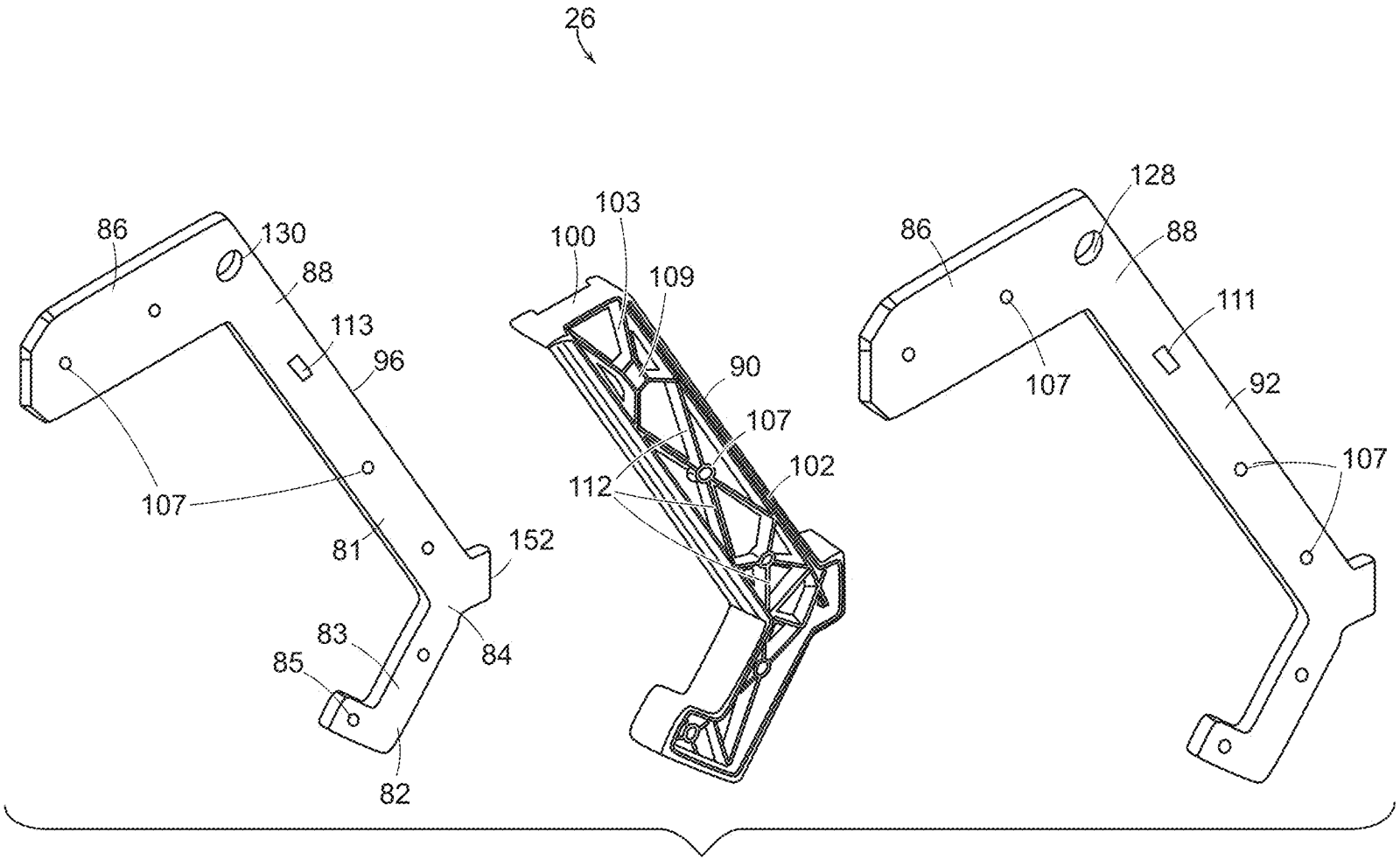
FIG. 5 is a perspective view, in exploded form, of a pivoting piece of the monolift assembly of FIG. 1.
Figure 6:
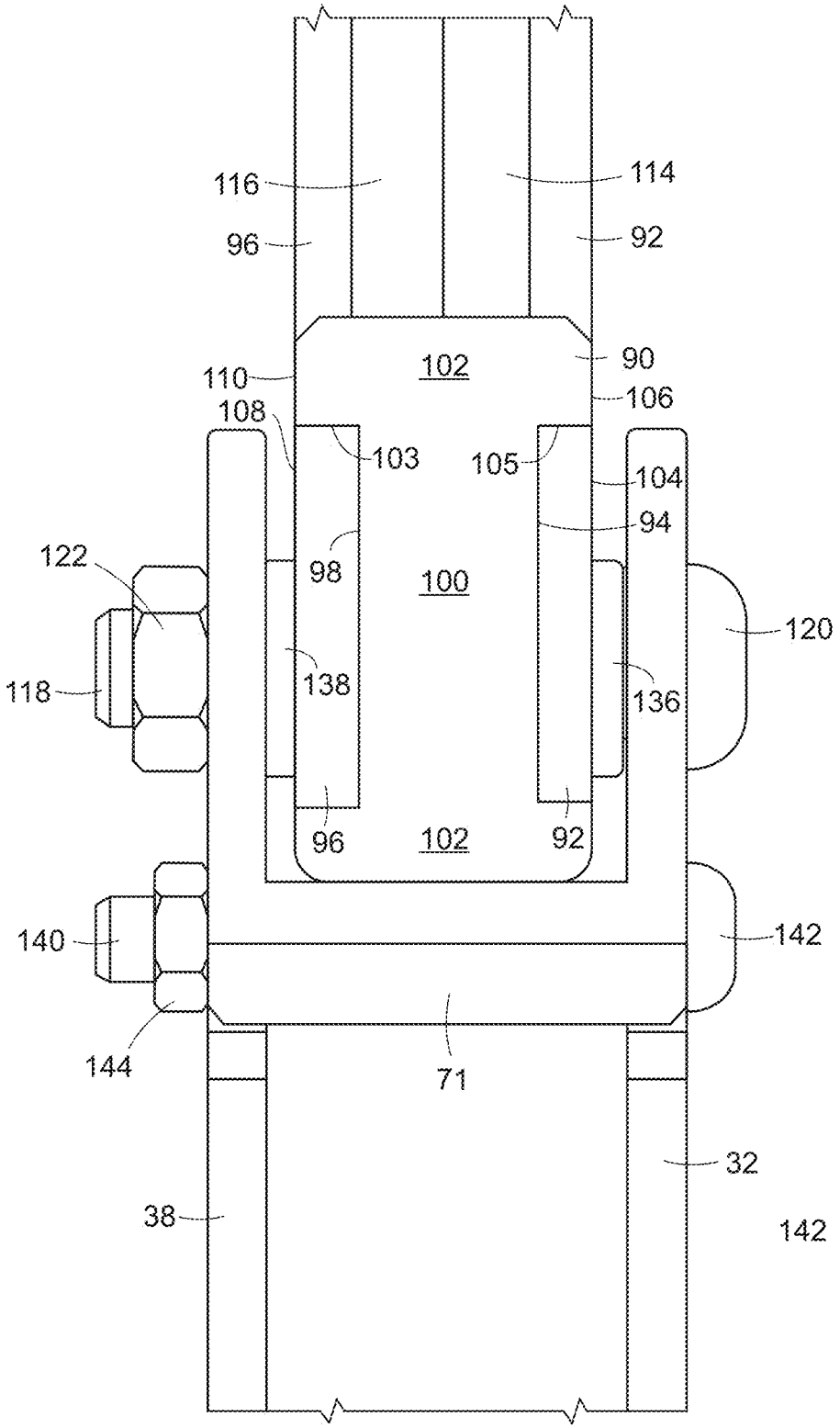
FIG. 6 is a section view of a portion of the monolift assembly of FIG. 1.
Figure 10:
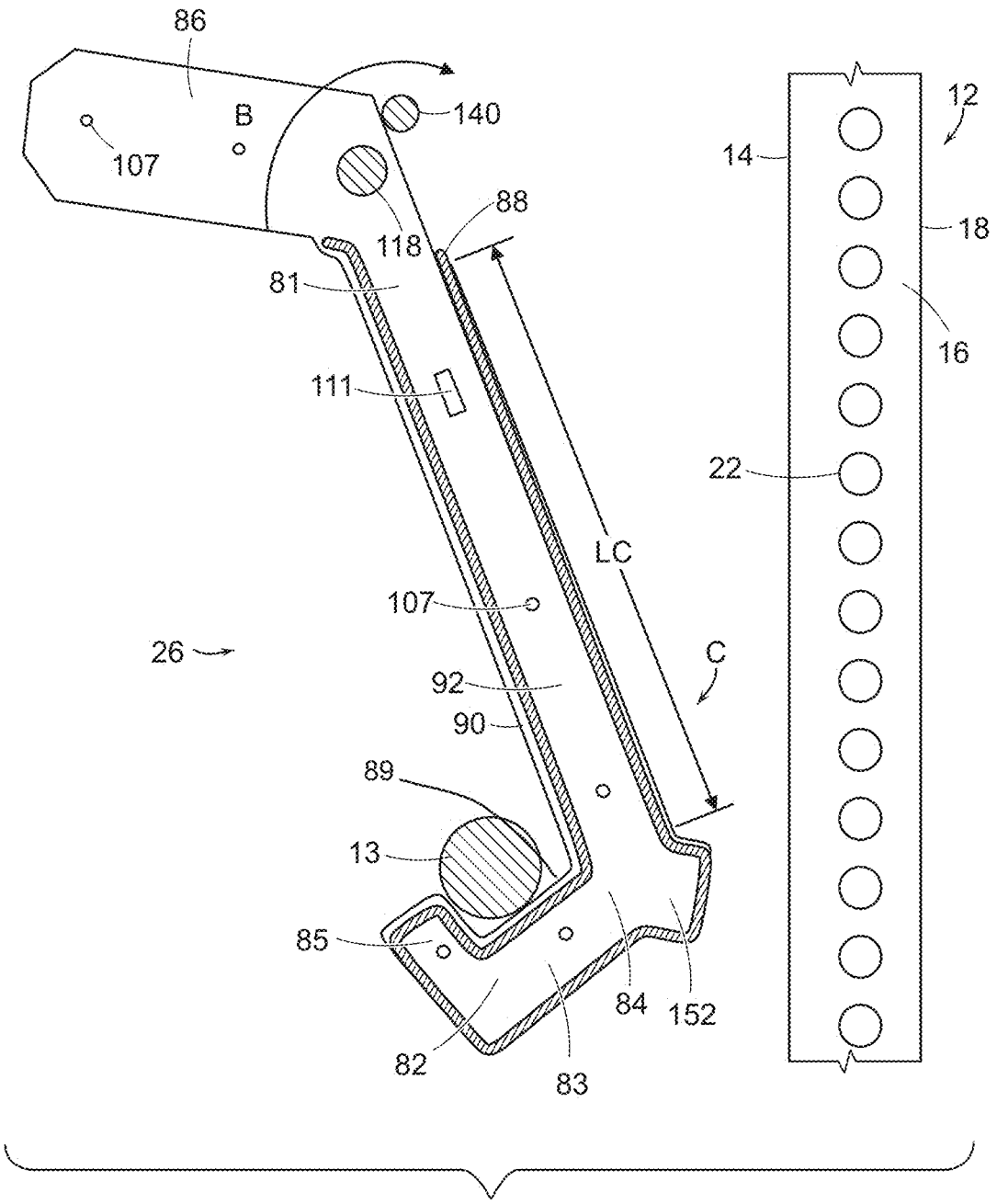
FIG. 10 is an elevation view of the monolift assembly of FIG. 1 secured to the post of FIG. 1, shown with a barbell seated on the monolift assembly.
Figure 11:
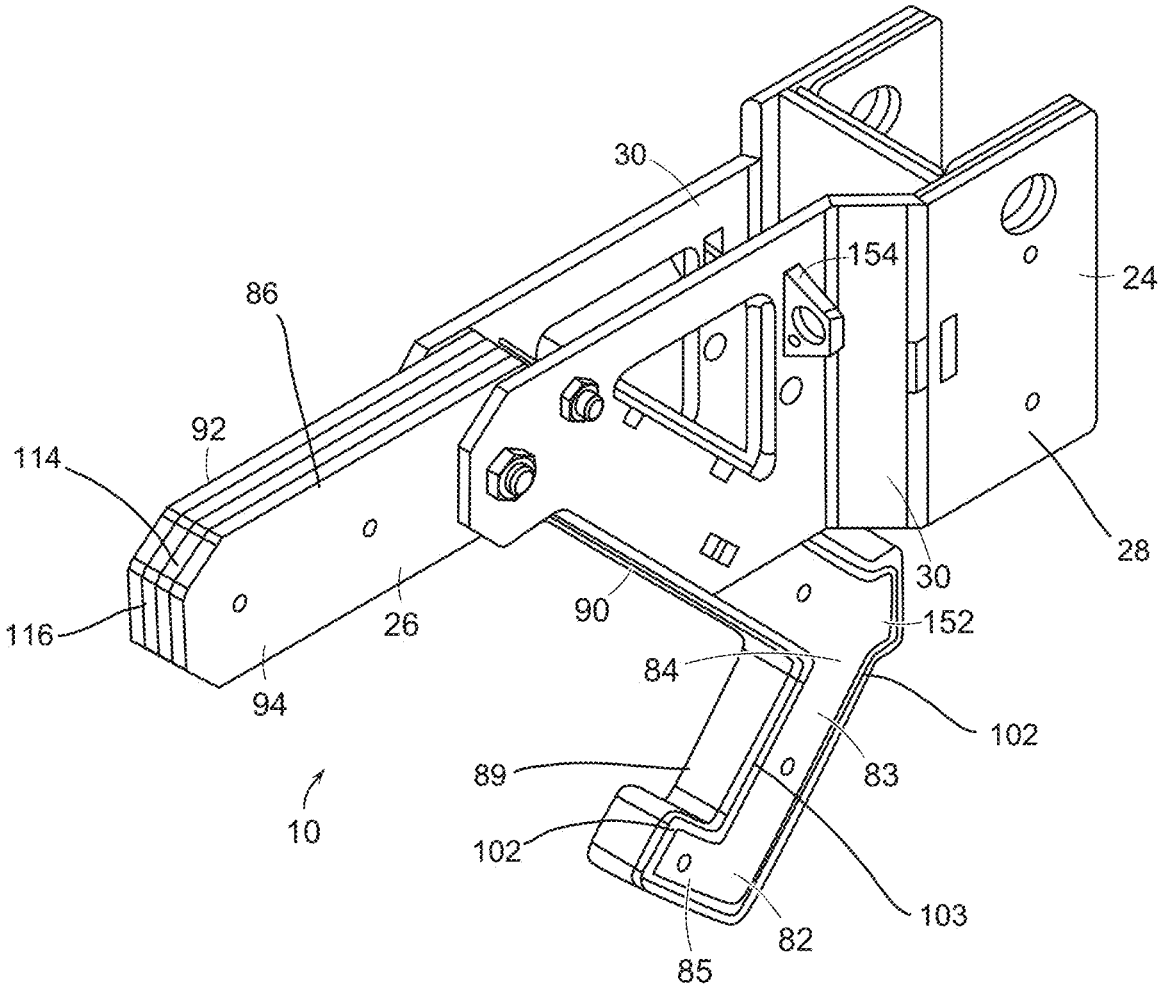
FIG. 11 is a perspective view of another embodiment of a monolift assembly according to aspects of the disclosure.

As seen in greater detail in FIGS. 5-6, pivoting piece 26 may be formed of multiple layers or pieces. Pivoting piece 26 may include a central plate 90, a first exterior plate 92 abutting a first side 94 of central plate 90, and a second exterior plate 96 abutting a second side 98 of central plate 90. As seen in FIG. 10, central portion 81 of pivoting piece 26 may have a length LC.

As seen in FIGS. 5-6, central plate 90 may include a web 100 and a flange 102 extending about a peripheral edge of web 100, providing central plate 90 with a substantially Y-shaped profile. As seen most clearly in FIG. 6, first exterior plate 92 may directly abut web 100 and be nested in a first recess 103 between portions of flange 102 such that an exterior surface 104 of first exterior plate 92 is substantially flush with, or recessed from, an exterior surface 106 of flange 102 on first side 94 of central plate 90. Similarly, second exterior plate 94 may directly abut web 100 and be nested in a second recess 105 between portions of flange 102 such that an exterior surface 108 of second exterior plate 94 is substantially flush with, or recessed from, an exterior surface 110 of flange 102 on second side 98 of central plate 90. In the configuration of FIGS. 1-10, hook 82 is formed by portions of central plate 90 and first and second exterior plates 92, 94.

Each of first exterior plate 92, central plate 90, and second exterior plate 94 may include a plurality of connecting apertures 107. A connector (not shown), such as a rivet, a pin, a bolt and nut, for example, may extend through each set of connecting apertures 107 to secure first exterior plate 92, central plate 90, and second exterior plate 94 to one another. It is to be appreciated that other elements of monolift assembly 10 may include one or more connecting apertures that receive corresponding connectors to secure the various elements of monolift assembly 10 together. Suitable connectors will become readily apparent to those skilled in the art, given the benefit of this disclosure.

A central key slot 109 may be formed in and extend through central plate 90. A first plate key slot 111 may be formed in and extend through first exterior plate 92, and a second plate key slot 113 may be formed in and extend through second exterior plate 96. The central key slot 109, first plate key slot 111, and second plate key slot 113 combine to form a slot through pivoting piece 26 configured to removably receive a key 154 as described herein.

Figure 14:
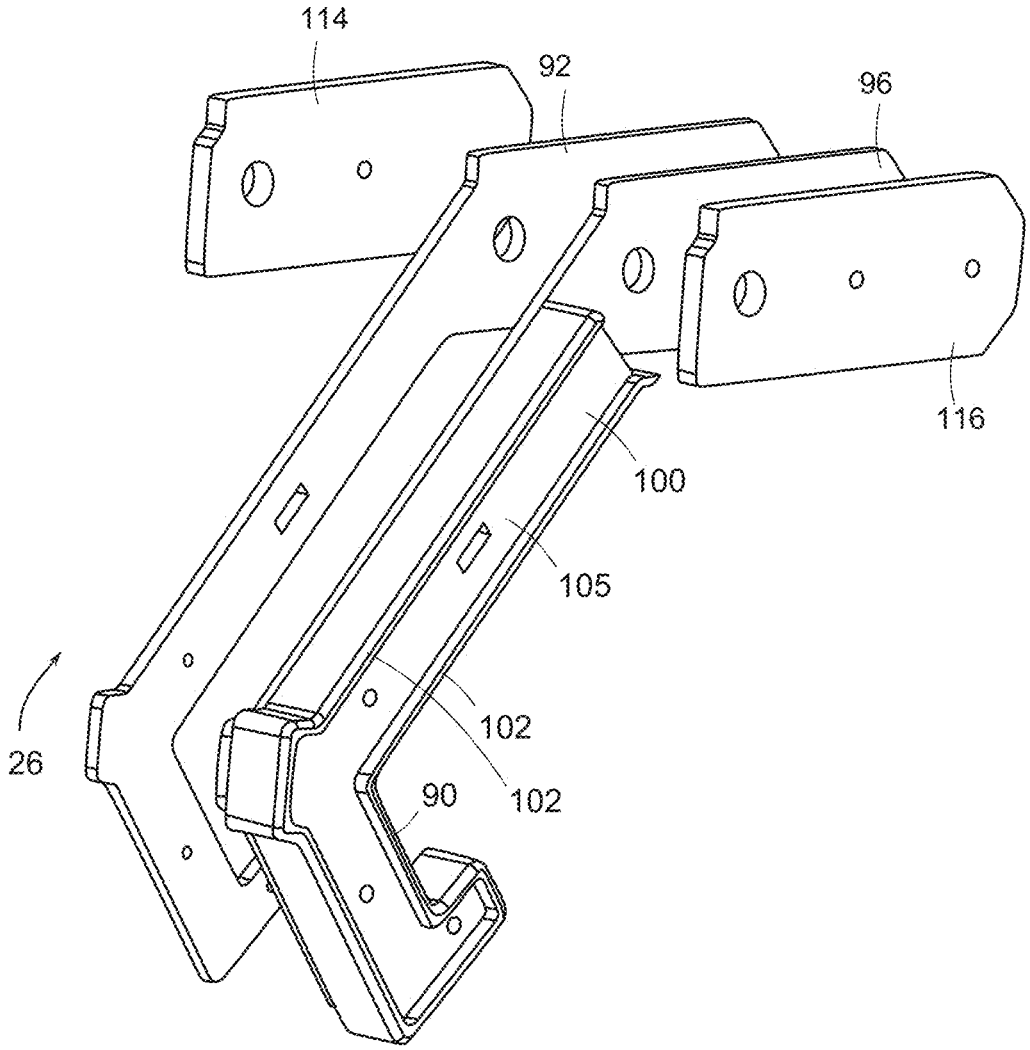
FIG. 14 is an exploded perspective view of the pivoting piece of the monolift assembly of FIG. 11.
Figure 15:
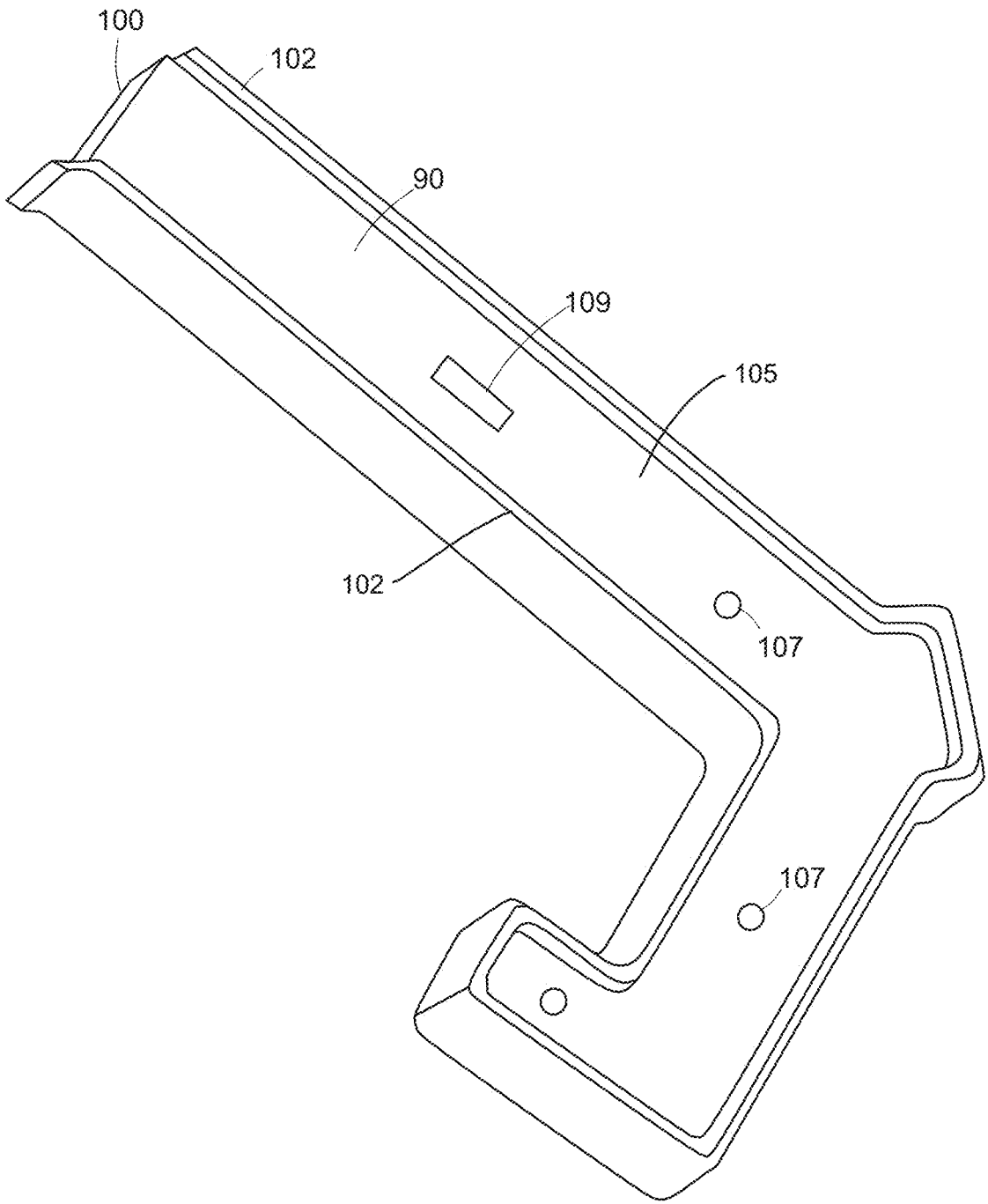
FIG. 15 is a perspective view of a central plate of the pivoting piece of the monolift assembly of FIG. 11.
Figure 16:
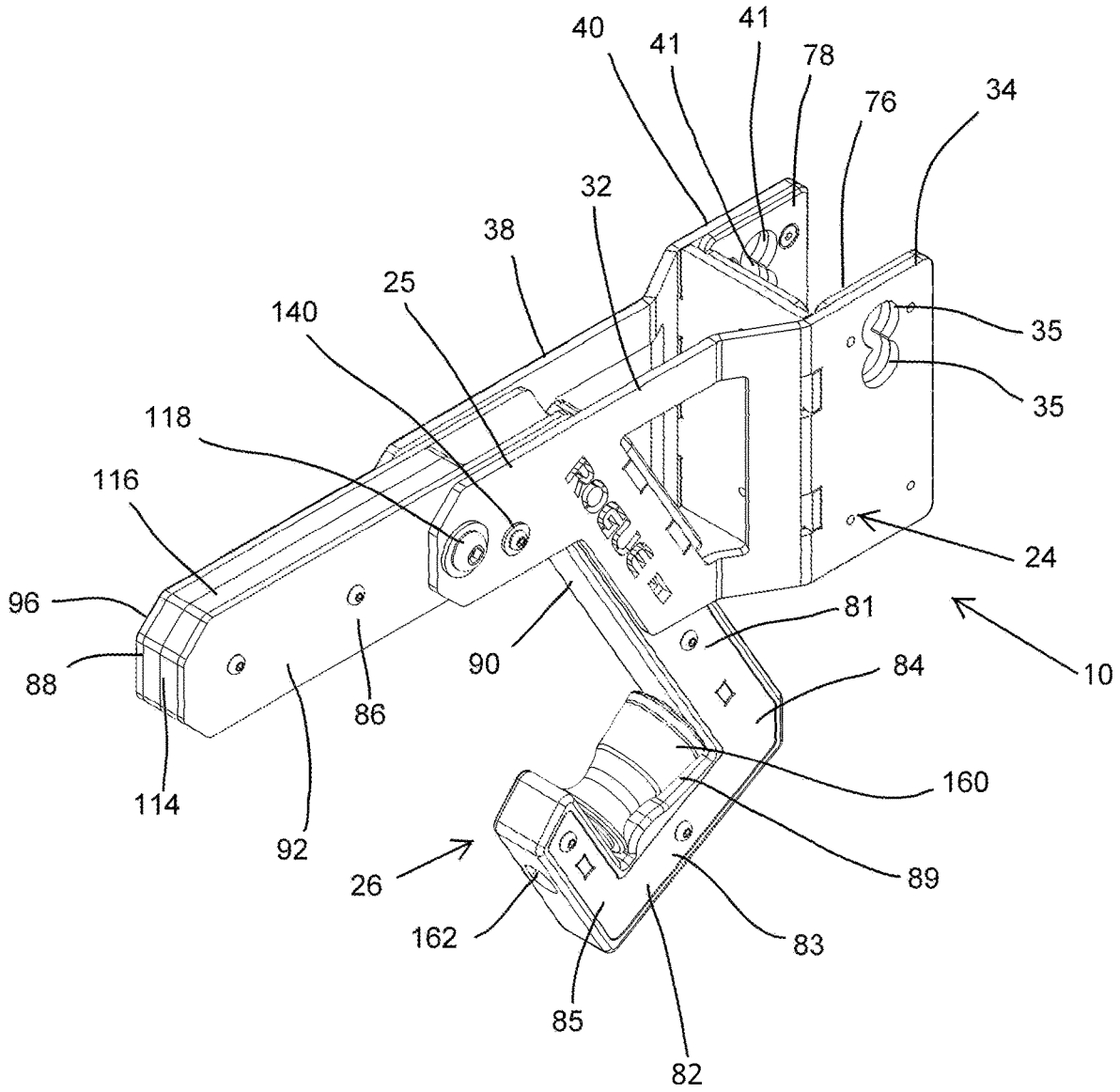
FIG. 16 is a perspective view of another embodiment of a monolift assembly according to aspects of the disclosure.
Figure 17:
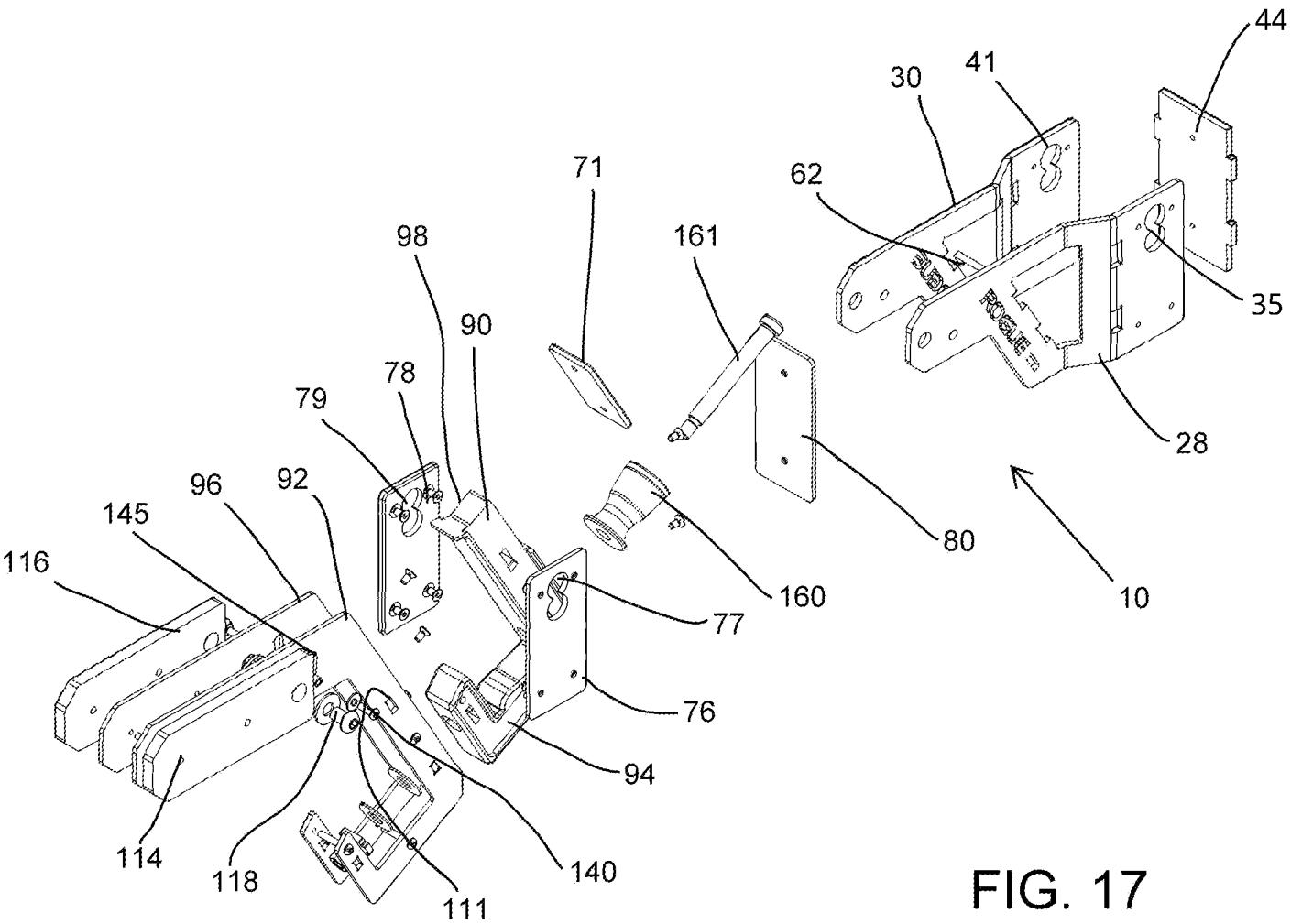
FIG. 17 is an exploded perspective view of the monolift assembly of FIG. 16.
Figure 18:
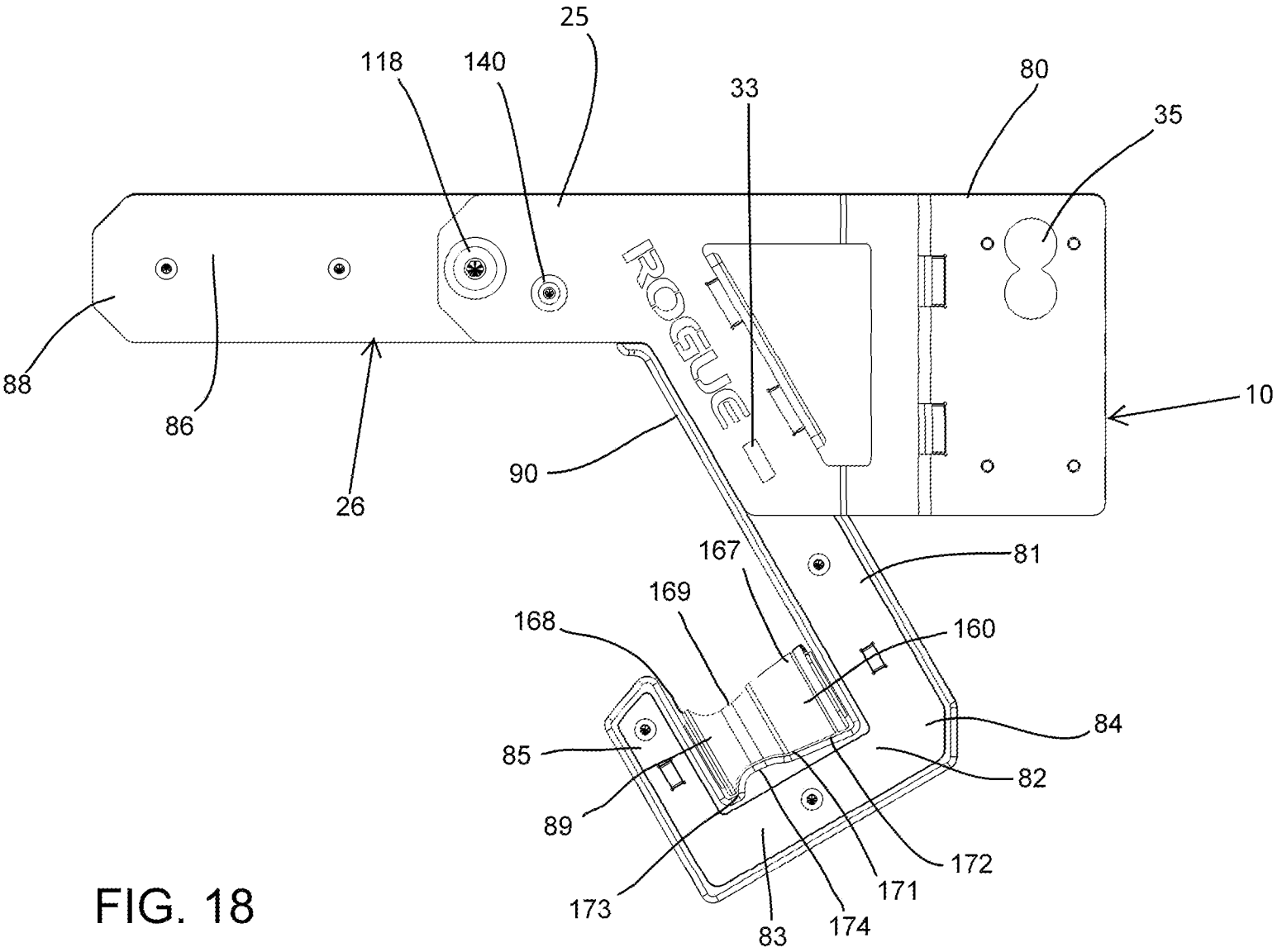
FIG. 18 is a side view of the monolift assembly of FIG. 16.
Figure 19:
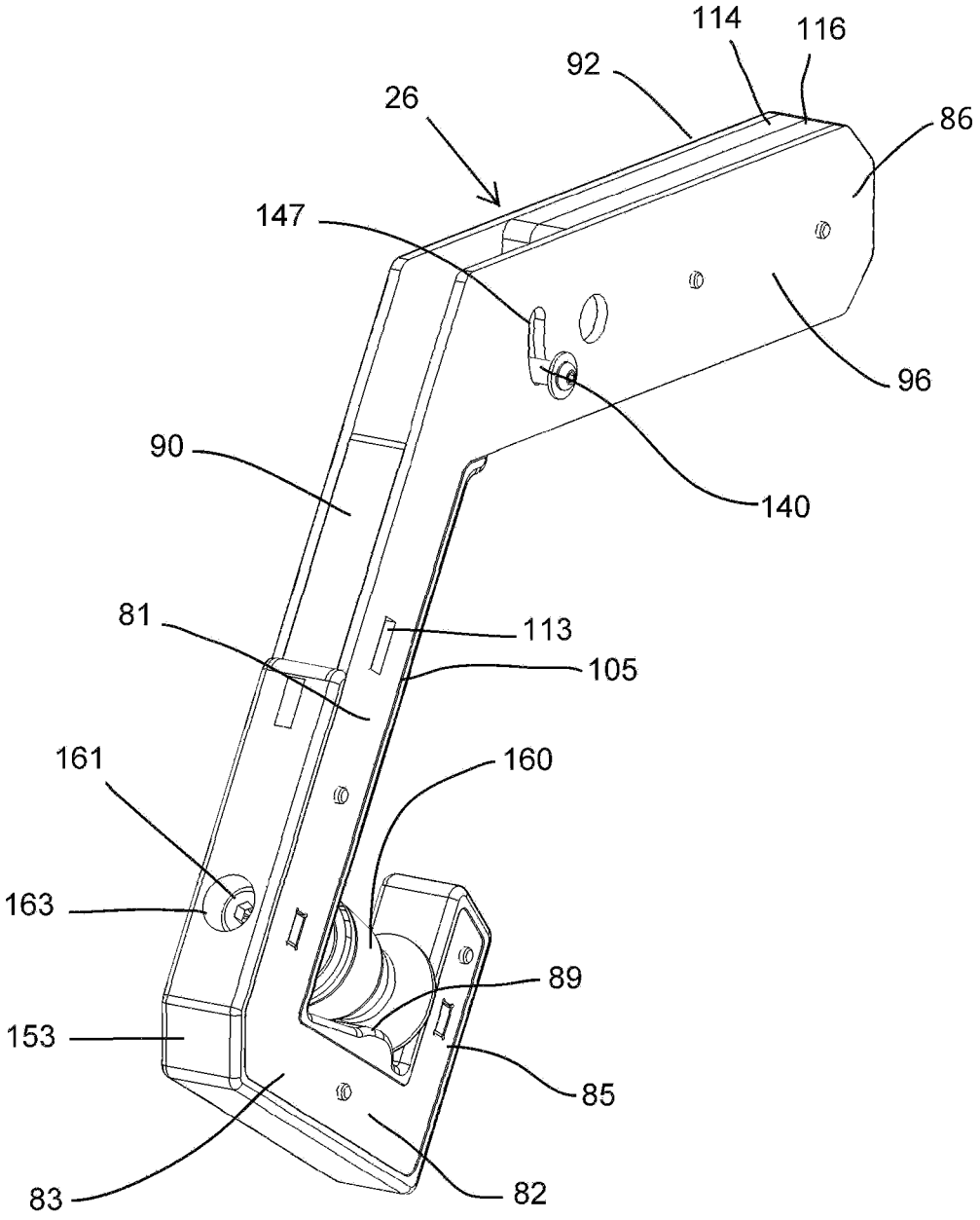
FIG. 19 is a rear perspective view of a pivoting piece of the monolift assembly of FIG. 16.

As seen in FIG. 5, exterior surfaces of web 100 of central plate 90 may include a plurality of ribs 112, which may add stability and strength to central plate 90, while minimizing the material used to make central plate 90, and its weight. In other embodiments, as seen in FIGS. 14-15, web 100 of central plate 90 may be free of ribs. In certain embodiments, central plate 90 may be formed of a polymer material, such as a hard plastic or composite material, e.g., a molded plastic piece.

In certain embodiments, pivoting piece 26 may be formed of a plurality of plates, including first and second exterior plates 92, 96, as well as one or more additional plates that may form at least part of counterweight 86. In the embodiment seen in FIG. 3, counterweight 86 may include a first counterweight plate 114 and a second counterweight plate 116 at second end 88 of central portion 81. As seen more clearly in FIG. 6, first counterweight plate 114 and second counterweight plate 116 are sandwiched between and secured to first exterior plate 92 and second exterior plate 96. First and second counterweight plates 114, 116 may serve to provide additional weight for counterweight 86, which in turn may allow the length L of counterweight 86 (seen in FIG. 9) to be reduced, thereby reducing the clearance needed for monolift assembly 10 and minimizing the risk from users bumping counterweight 86 (e.g., with their head) and harming themselves. First and second exterior plates 92, 96 and first and second counterweight plates 114, 116 may be formed of metal such as steel, and first and second exterior plates 92, 96 and first and second counterweight plates 114, 116 may be formed of the same material in one embodiment. In another embodiment, first and second counterweight plates 114, 116 may be formed of a metal or other material with greater density than a material of first and second exterior plates 92, 96. Other suitable materials for first and second counterweight plates 114, 116 will become readily apparent to those skilled in the art, given the benefit of this disclosure.

As seen in FIG. 1, pivoting piece 26 may be pivotally secured to carriage assembly 24 by a pivot pin 118. In certain embodiments, as seen in FIG. 6, pivot pin 118 may be formed of a bolt 120 and mating nut 122. It is to be appreciated that pivot pin 118 may be any type of pin, shaft, rod, brad, or other element that allows free rotation of pivoting piece 26 with respect to carriage assembly 24.

Figure 3:
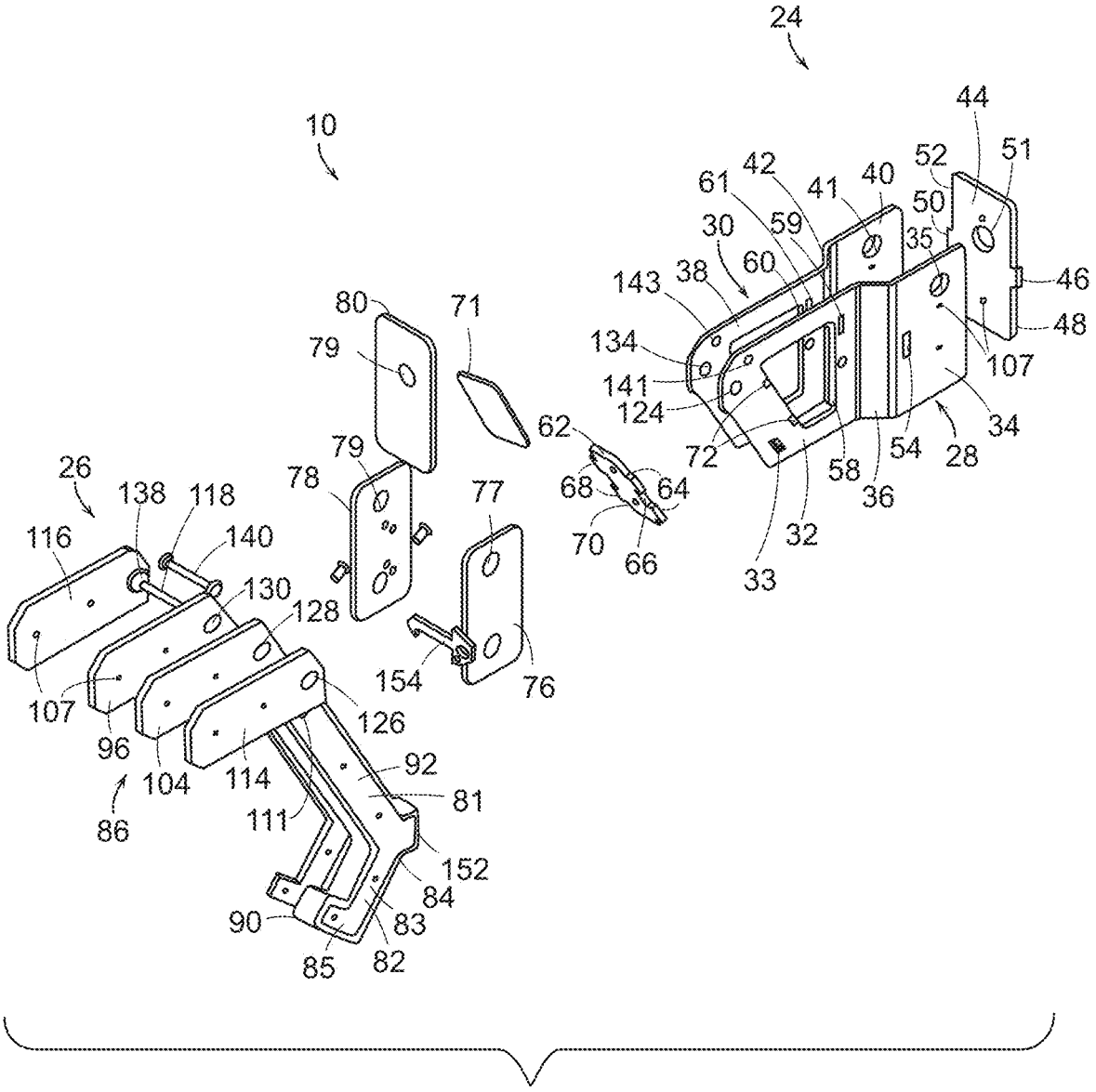
FIG. 3 is a front perspective view, in exploded form, of the monolift assembly of FIG. 1.
Figure 4:
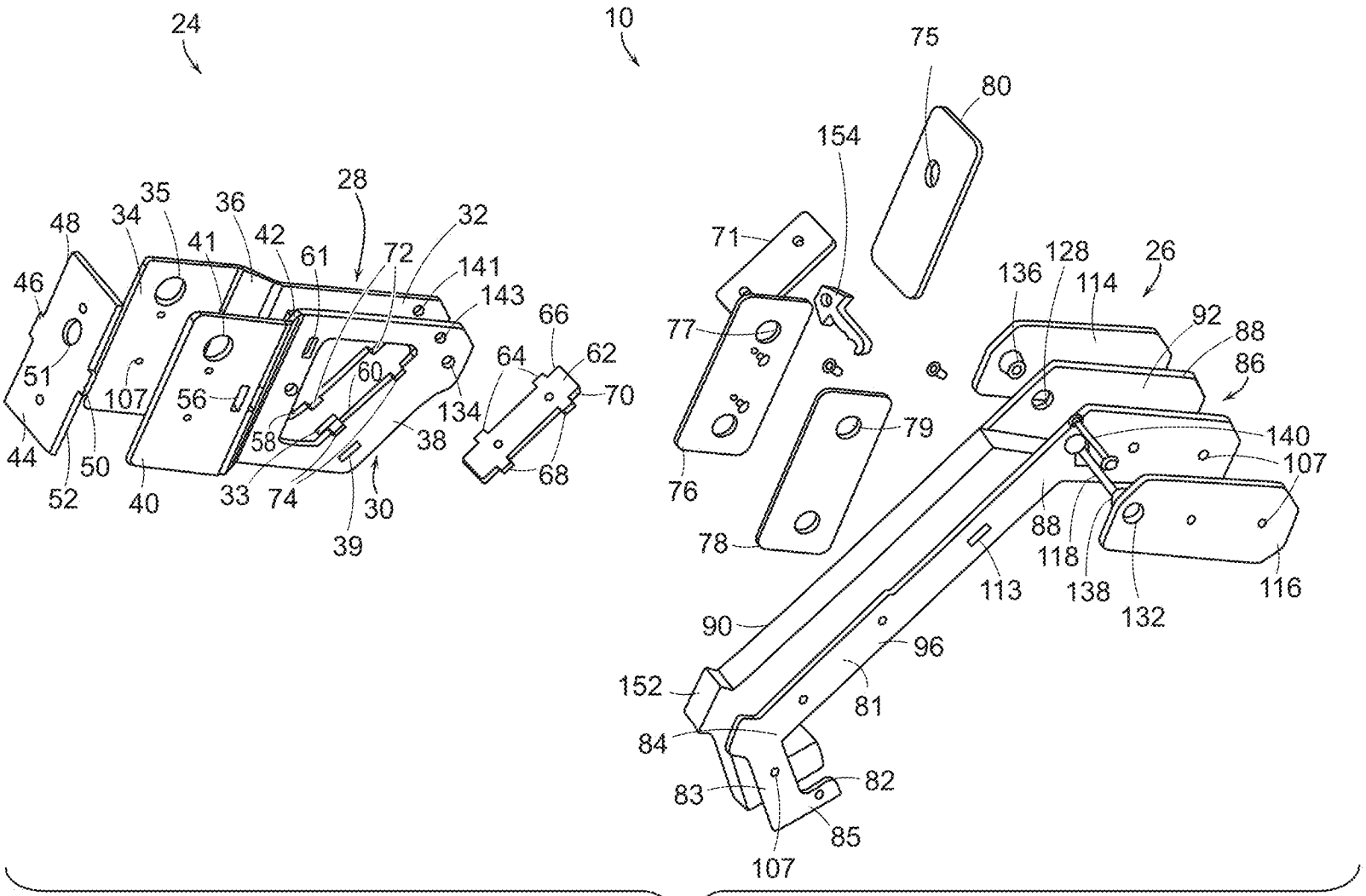
FIG. 4 is a rear perspective view, in exploded form, of the monolift assembly of FIG. 1.

As seen in FIGS. 3 and 6, pivot pin 118 may extend through a first leg aperture 124 formed in first leg portion 32, a first plate aperture 128 formed in first exterior plate 92, a first counterweight aperture 126 formed in first counterweight plate 114, a second counterweight aperture 132 formed in second counterweight plate 116, a second plate aperture 130 formed in second exterior plate 96, and a second leg aperture 134 formed in second leg portion 38. A first bushing 136 may be seated on pivot pin 118 between first leg portion 32 and first exterior plate 92, and a second bushing 138 may be seated on pivot pin 118 between second leg portion 38 and second exterior plate 96.

A stop pin 140 may be secured to carriage assembly 24, and may serve to stop the rotation of pivoting piece 26 when barbell 13 is placed on hook 82, as illustrated in FIGS. 9-10, and described in greater detail below. Stop pin 140 may extend through a first stop aperture 141 formed in and extending through first leg portion 32 and a second stop aperture 143 formed in an extending through second leg portion 38. In certain embodiments, as seen in FIG. 6, stop pin 140 may be formed of a bolt 142 and mating nut 144. It is to be appreciated that stop pin 140 may be any type of pin, shaft, rod, brad, or other element that allows free rotation of pivoting piece 26 with respect to carriage assembly 24.

As noted above, carriage assembly 24 may be removably secured to post 12. As seen in FIGS. 7-8, one or more locking pins may be used to secure carriage assembly 24 to post 12 at a desired height. In certain embodiments, a first locking pin 146 may be used to secure first arm portion 34 and second arm portion 40 to sidewalls 16 of post 12. First locking pin 146 may extend through first arm aperture 35 in first arm portion 34, through a pair of opposed apertures 22 in post 12, and through second arm aperture 41 in second arm portion 40, thereby securing carriage assembly 24 vertically with respect to post 12. In certain embodiments, first locking pin 146 may have a bent portion 148 at one end thereof, which may help keep first locking pin 146 in position with respect to post 12.

A second locking pin 150 may be used to secure arm connecting plate 44 to front wall 14 and rear wall 18 of post 12. Second locking pin 150 may extend through arm connecting plate aperture 51, through arm connecting plate pad aperture 81, through apertures 22 in front wall 14 and rear wall 18 of post 12. In certain embodiments, second locking pin 150 may also have a bent portion (not shown) at one end thereof, which may help keep second locking pin 150 in position with respect to post 12.

Figure 12:
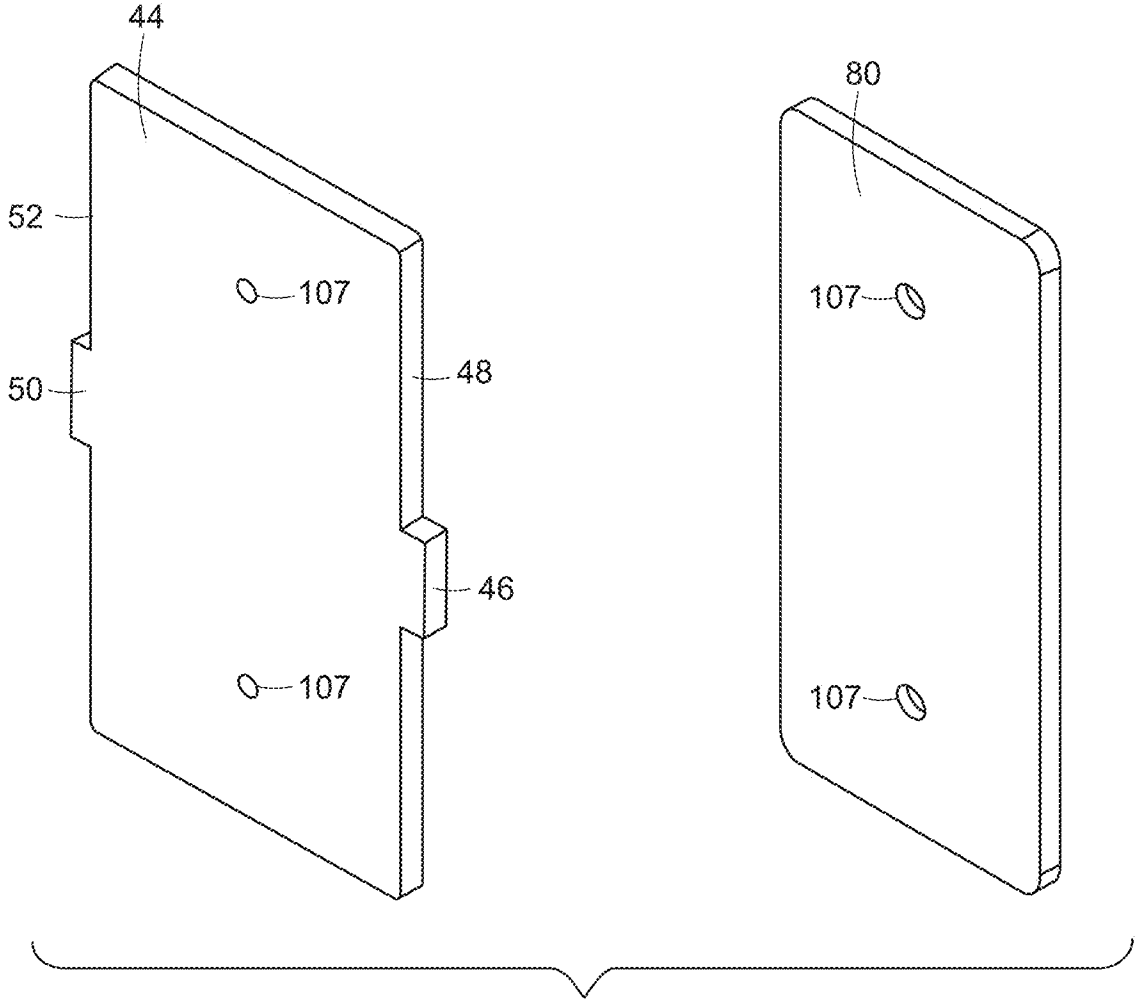
FIG. 12 is a perspective view of an arm connecting plate and arm connecting plate pad of the monolift assembly of FIG. 11.
Figure 13:
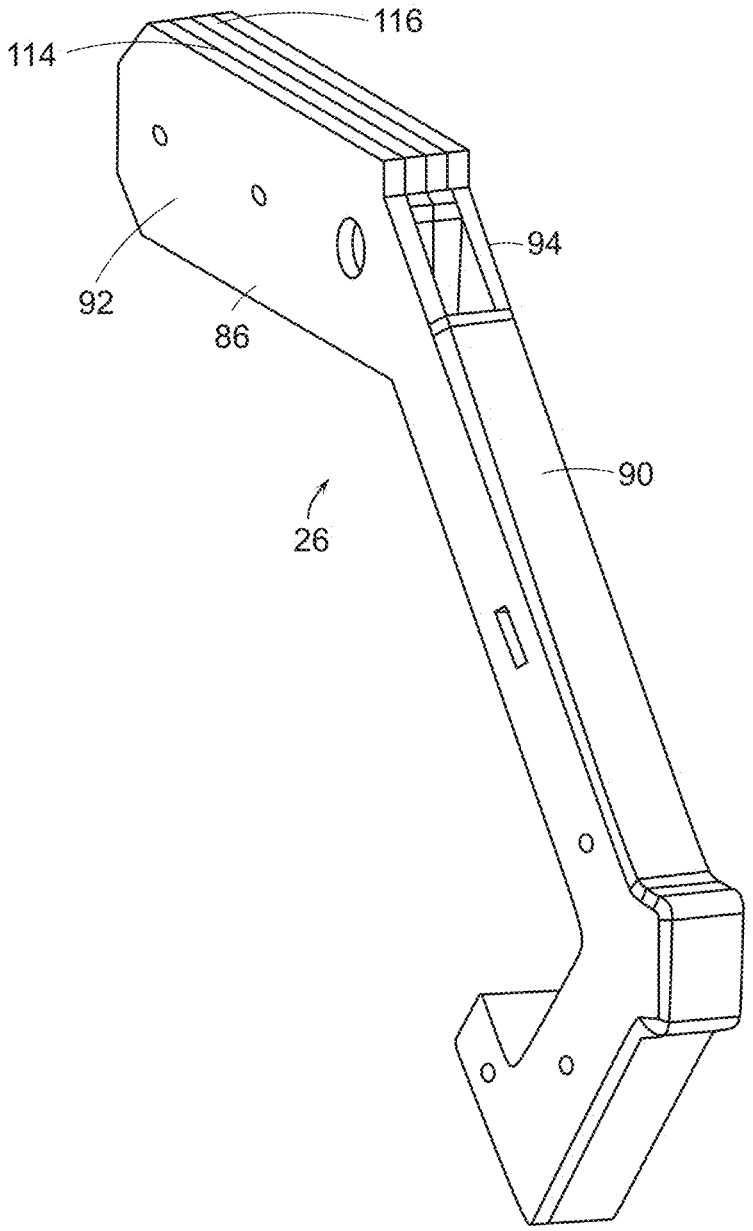
FIG. 13 is a rear perspective view of a pivoting piece of the monolift assembly of FIG. 11.

In some embodiments, only first locking pin 146 may be used to secure first arm portion 34 and second arm portion 40 to sidewalls 16 of post 12. In such embodiments, as illustrated in FIG. 12, arm connecting plate 44 does not include an arm connecting plate aperture, and arm connecting plate pad 80 does not include an arm connecting plate pad aperture.

It is to be appreciated that first locking pin 146 and second locking pin 150 may be a detent, a bolt and nut, a rod, a shaft, or any other element that can be inserted into and removed from corresponding apertures in carriage assembly 24 and post 12.

The operation of monolift assembly 10 will now be described in conjunction with FIGS. 9-10. FIG. 9 illustrates barbell 13 in use by the user and spaced from monolift assembly 10. Without barbell 13 positioned on hook 82, counterweight 86 of pivoting piece 26 may rotate downwardly about pivot pin 118 in the direction of arrow A (counterclockwise as seen here) until a shoulder 152 extending outwardly from pivoting piece 26 engages front wall 14 of post 12. As noted above, the use of first and second counterweight plates 114, 116 may reduce length L of counterweight 86, thereby reducing the total distance D that monolift assembly 10 extends outwardly from post 12, thereby minimizing the risk of the user inadvertently bumping into monolift assembly 10 during use.

When barbell 13, which may have multiple weight plates secured thereto, is seated on hook 82, as seen in FIG. 10, the weight on barbell 13 will overcome counterweight 86, causing counterweight 86 to rotate upwardly about pivot pin 118 in the direction of arrow A (clockwise as seen here) until pivoting piece 26 contacts stop pin 140. In this position, shoulder 152 moves outwardly away from front wall 14 of post 12 in the direction of arrow C. In one embodiment, all surfaces defining the notch 89, including adjacent surfaces of central portion 81, leg 83, and protrusion 85, are formed by central plate 90 and are formed of the polymer material. Central plate 90 thereby shields the barbell 13 or other article from the metallic material of first and second exterior plates 92, 96, reducing wear on the article 13 held by hook 82.

A key 154 may be used to prevent rotation of pivoting piece 26 with respect to carriage assembly 24. When the user is using monolift assembly 10, key 154 may be stored in an unlocked condition on carriage assembly 24. Key 154 may be inserted into and received in first key storage slot 59 in first arm portion 34 and second key storage slot 61 in second arm portion 40 in the unlocked condition. In use, to prevent rotation of pivoting piece 26 with respect to carriage assembly 24, key 154 may be inserted into and received in first key slot 33 in first leg portion 32, first key plate slot 111 in first exterior plate 92, central key slot 109 in central plate 90, second key plate slot 113 in second exterior plate 96, and second key slot 39 in second leg portion 38 to provide a locked condition. When key 154 is in the locked condition, pivoting piece 26 cannot be rotated with respect to carriage assembly 24.

FIGS. 11-15 illustrate another example embodiment of a monolift assembly 10 that includes many components and features in common with the monolift assembly 10 in FIGS. 1-10 and functions in a similar manner. As such, the components, features, and functionality of the monolift assembly 10 in FIGS. 11-15 are not described in detail herein, and may not all be indicated by reference numbers in the drawing figures, for the sake of brevity and conciseness.

The embodiment of the monolift assembly 10 in FIGS. 11-15 includes a pivoting piece 26 having a shorter length than the pivoting piece 26 of FIGS. 1-10, and having a central piece 90 with a different configuration, as described herein. The monolift assembly 10 in FIGS. 11-15 also has an arm connecting plate 44 and a connecting plate pad 80 that are configured differently from the same components in the embodiment of FIGS. 1-10. In particular, arm connecting plate 44 in FIGS. 11-15 does not include an arm connecting plate aperture 51 as in FIGS. 1-10.

Figure 22:
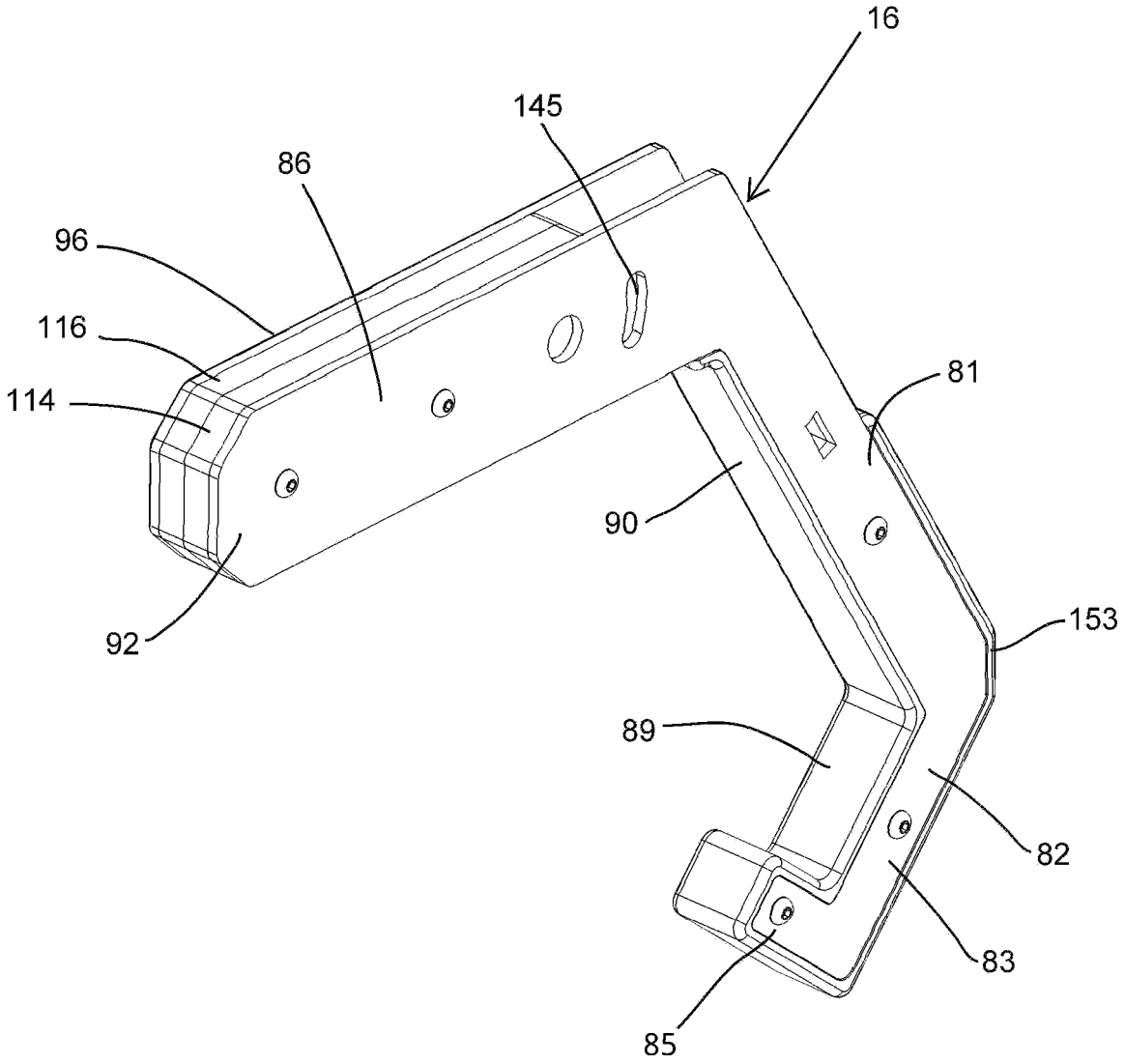
FIG. 22 is a perspective view of another embodiment of a pivoting piece usable with the monolift assembly of FIG. 16.
Figure 23:
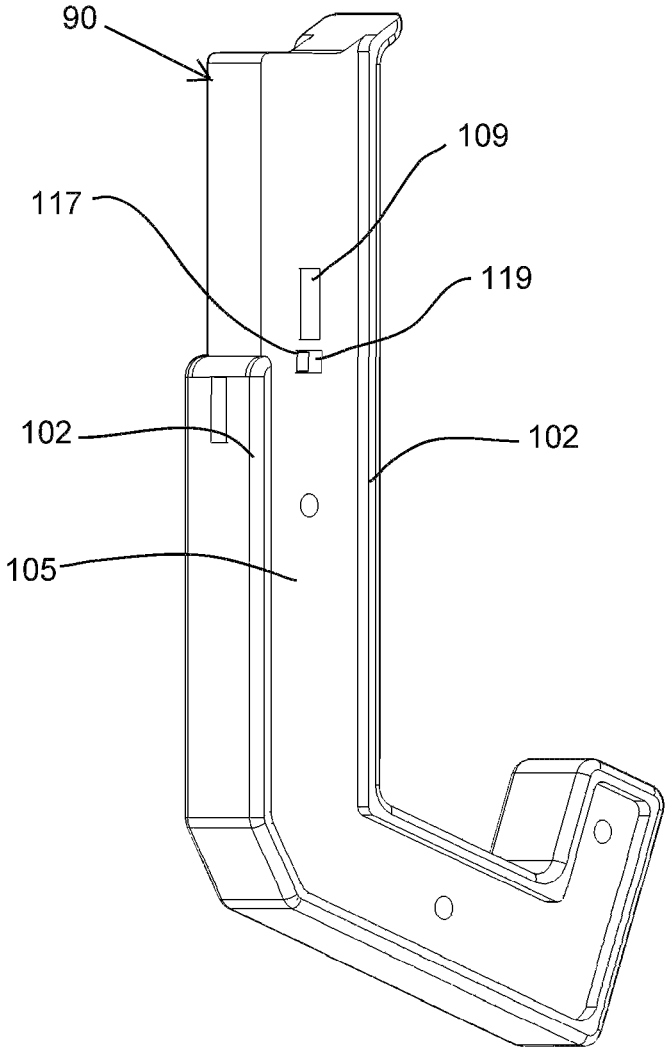
FIG. 23 is a rear perspective view of a central plate of the pivoting piece of FIG. 22.

FIGS. 16-21 illustrate another embodiment of a monolift assembly 10, and FIGS. 22-23 illustrate another embodiment of a pivoting piece that is usable in connection with the monolift assembly 10 of FIGS. 16-21 or another assembly appropriately configured. The embodiments of FIGS. 16-23 include many components and features in common with the monolift assemblies 10 in FIGS. 1-15 and functions in a similar manner. As such, the components, features, and functionality of the monolift assembly 10 in FIGS. 16-23 are not described in detail herein, and may not all be indicated by reference numbers in the drawing figures, for the sake of brevity and conciseness.

The carriage assembly 24 of FIGS. 16-21 is structured similarly to the carriage assemblies 24 of FIGS. 1-4 and 11. First and second leg portions 32, 38 of carriage assembly 24 in this embodiment have a protruding nose 25 having approximately the same vertical height as counterweight 86. Pivot pin 118 and stop pin 140 both extend through nose 25 and pivoting piece 26 at this location. Pivot pin 118 in the embodiments of FIGS. 16-23 is a machined pin that permits smoother swing of pivot piece 26, without requiring proper screw adjustment. The remaining portions of leg portions 32, 38 in this embodiment are recessed toward arm portions 34, 40 to provide more room for placing the barbell 13 in hook 82. Additionally, arm portions 34, 40 both include multiple arm apertures 35, 41, which are configured to create multiple vertically offset mounting configurations for carriage assembly 24. Carriage assembly 24 in this embodiment has two arm apertures 35 41 on each arm portion 34, 40, which are interconnected to create an offset of 1 inch. Arm pads 76, 78 in this embodiment also include multiple apertures 77, 79 having similar configurations.

Pivoting piece 26 in FIGS. 16-21 and 22-23 has a different overall shape from the pivoting pieces 26 in FIGS. 1-15, with different profile shapes having, among other differences, a longer counterweight 86, a longer leg 83, a shorter central portion 81 length LC, and no protruding shoulder 152. Instead of the protruding shoulder 152, pivoting piece 26 in these embodiments simply has a flat surface 153 that is vertical in the farthest rearward position to engage front wall 14 of post 12. Additionally, the thicknesses of first and second counterweight plates 114, 116 is larger relative to the thicknesses of first and second exterior plates 92, 96 in FIGS. 16-21 and 22-23.

Pivoting piece 26 in FIGS. 16-21 and 22-23 has arcuate stop pin slots 145, 147 through first and second exterior plates 92, 96, respectively. Stop pin 140 extends through stop pin slots 145, 147 and travels along stop pin slots 145, 147 as pivoting piece 26 pivots. The lengths of stop pin slots 145, 147 thereby define the range of pivoting motion of pivoting piece 26, as the pivoting of pivoting piece 26 is stopped by stop pin 140 engaging either end of stop pin slots 145, 147. This configuration of stop pin 140 avoids visible wear, e.g., paint damage, due to pivoting piece 26 impacting stop pin 140.

Figure 20:
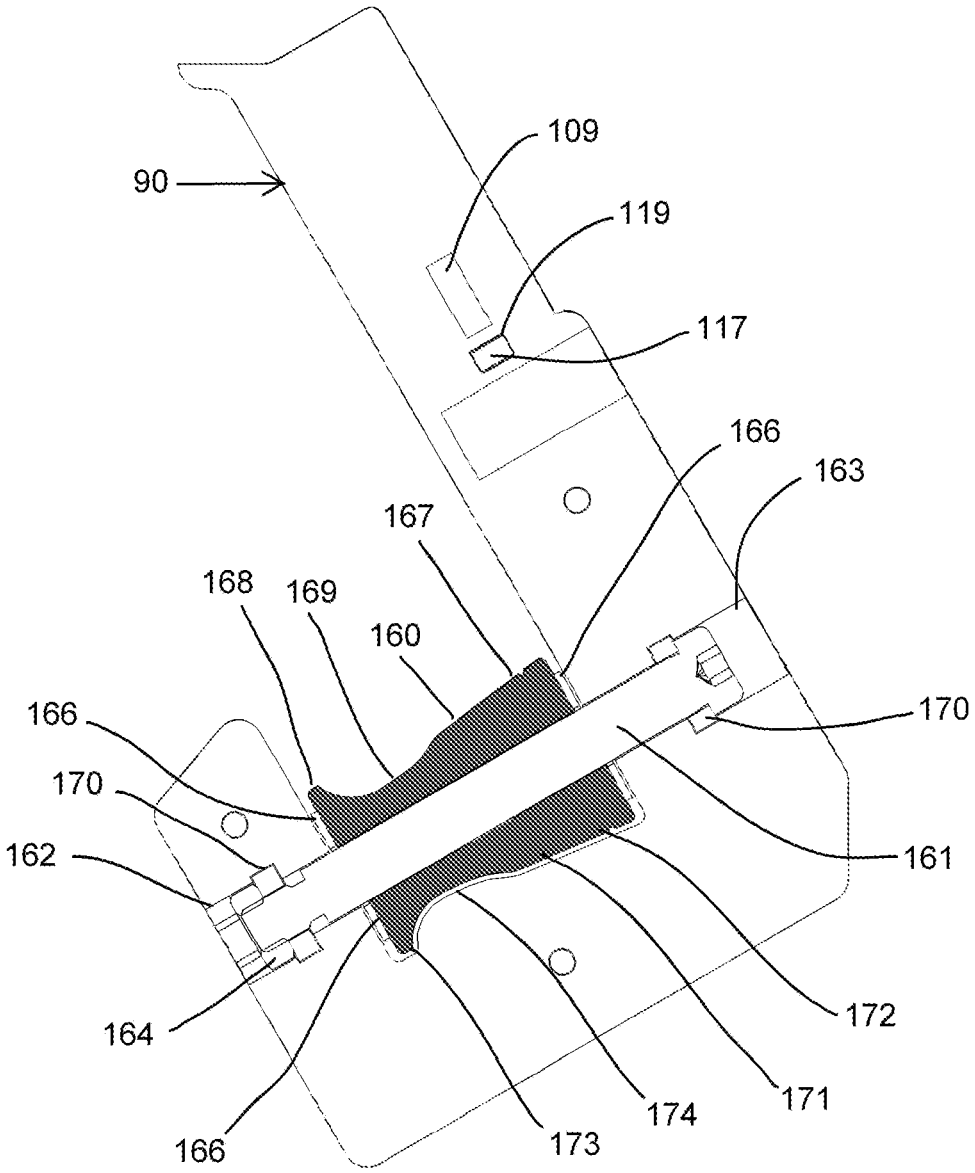
FIG. 20 is a section view of a portion of the pivoting piece of FIG. 19.
Figure 21:
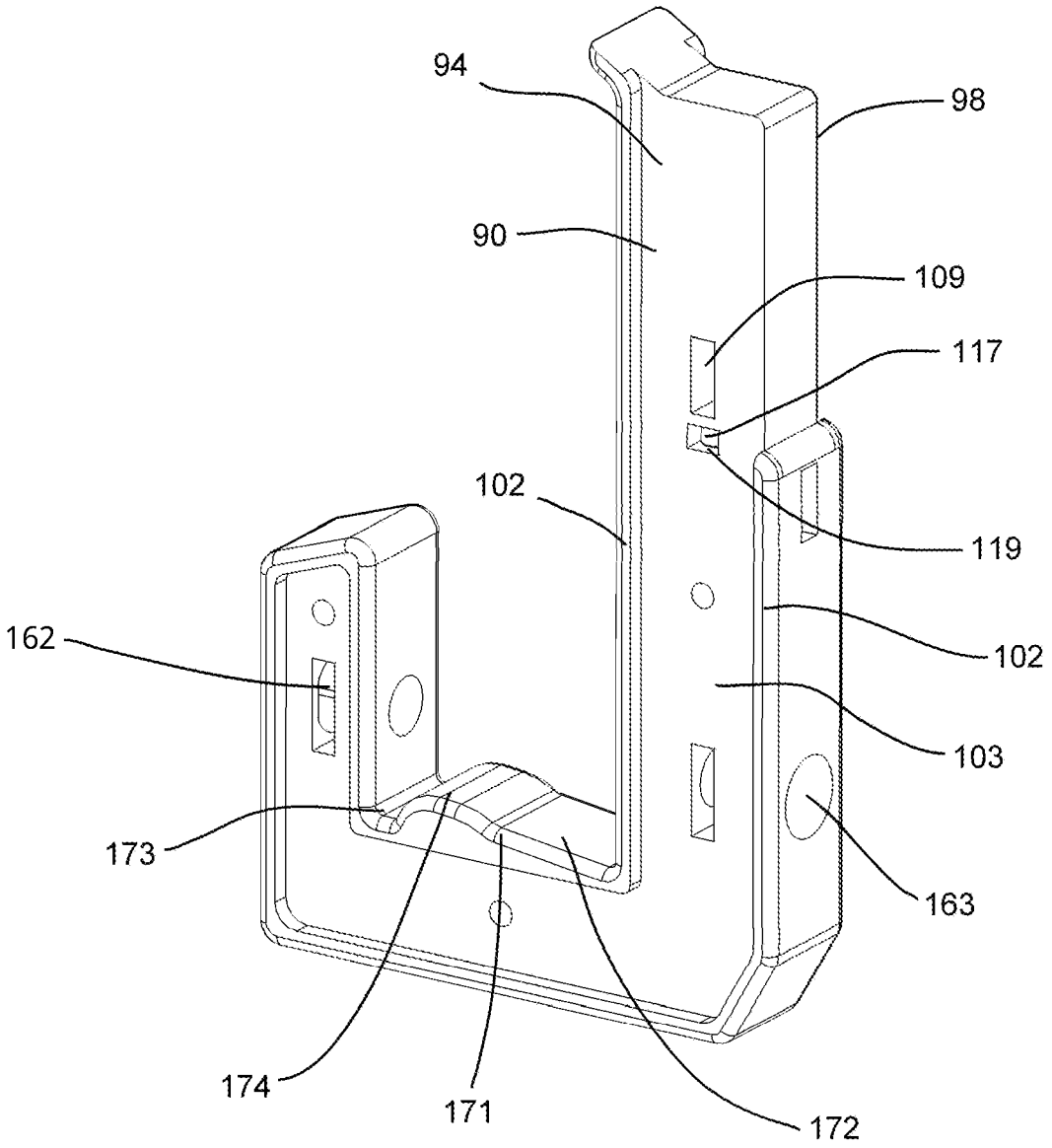
FIG. 21 is a rear perspective view of a central plate of the pivoting piece of FIG. 19.

Pivoting piece 26 in FIGS. 16-21 and 22-23 also has an internal magnet 117 positioned adjacent to key slot(s) 109, 111, 113 that functions to retain key 154 within the slot created by key slots 109, 111, 113 by magnetic force. In the embodiments of FIGS. 16-21 and 22-23, central plate 90 includes an internal cavity 119 adjacent to key slot 109 that holds internal magnet 117, as seen in FIG. 20.

Pivoting piece 26 in FIGS. 16-21 further has a roller 160 rotatably connected to hook 82 within notch 89, which is configured and positioned such that the barbell 13 or other weightlifting article rests on roller 160 when engaged with hook 82. Roller 160 in FIGS. 16-21 is rotatably mounted on central plate 90 by a bolt 161 extending through apertures 162, 163 in protrusion 85 and central portion 81, respectively. Bolt 161 defines an axis of rotation for roller 160 that extends substantially parallel to leg 83 and perpendicular or otherwise transverse to the surfaces of protrusion 85 and central portion 81 defining notch 89. Aperture 162 in protrusion 85 has a hexagonal shape to rotatably fix nut 164 during threading on bolt 161. Connectors 170 extend through central plate 90 to engage exterior plates 92, 96, and bolt 161 passes through connectors 170 in this configuration as well. Washers or bushings 166 are positioned at the ends of roller 160 to space roller 160 from the surfaces of protrusion 85 and central portion 81, to reduce wear and friction. Roller 160 has a contoured surface that is rotationally symmetrical with respect to the axis of rotation defined by bolt 161. Roller 160 in this embodiment has a barrel portion 167 that is cylindrical or frusto-conical, a circumferential front lip 168 at the opposite end of roller 160, and a circumferential recess 169 that is recessed radially inward from barrel portion 167 and front lip 168 to form a narrowest portion of roller 160. Recess 169 has a smoothly curved contour and is configured to receive and engage a portion of the barbell 13 or other weightlifting article when the article is received in hook 82. Protrusion 85 may engage the barbell 13 when received in hook 82 as well. Rotation of roller 160 reduces friction and stress on monolift assembly 10 when moving the barbell 13 laterally, facilitating adjusting position of the barbell 13 while engaged with pivoting piece 26. Leg 83 has a top surface 171 that has a complementary mating profile shape with roller 160, with recesses 172, 173 to receive barrel portion 167 and front lip 168 and a rounded hump 174 to fit within recess 169.

Various embodiments of monolift assemblies have been described herein, which include various components and features. In other embodiments, the monolift assemblies may be provided with any combination of such components and features. It is also understood that in other embodiments, the various devices, components, and features of the monolift assemblies described herein may be constructed with similar structural and functional elements having different configurations, including different ornamental appearances.

Those having skill in the art, with the knowledge gained from the present disclosure, will recognize that various changes can be made to the disclosed apparatuses and methods in attaining these and other advantages, without departing from the scope of the present disclosure. As such, it should be understood that the features described herein are susceptible to modification, alteration, changes, or substitution. For example, it is expressly intended that all combinations of those elements and/or steps which perform substantially the same function, in substantially the same way, to achieve the same results are within the scope of the embodiments described herein. Substitutions of elements from one described embodiment to another are also fully intended and contemplated. The specific embodiments illustrated and described herein are for illustrative purposes only, and not limiting of that which is set forth in the appended claims. Other embodiments will be evident to those of skill in the art. It should be understood that the foregoing description is provided for clarity only and is merely exemplary. The spirit and scope of the present disclosure is not limited to the above examples, but is encompassed by the following claims.

What is claimed is:

1. A monolift assembly comprising:

a carriage assembly configured to be releasably secured to a post of a weight rack; and a pivoting piece pivotally connected to the carriage assembly and having a hook at a first end thereof and a counterweight at a second end thereof, the pivoting piece comprising:

a central plate formed of a polymer material and having a first recess on a first side and a second recess on a second side opposite the first side;

a first exterior plate connected to the first side of the central plate such that a portion of the first exterior plate is received in the first recess; and a second exterior plate connected to the second side of the central plate such that a portion of the second exterior plate is received in the second recess, wherein the first and second exterior plates are metallic.

2. The monolift assembly of claim 1, wherein the carriage assembly comprises a first carriage plate and a second carriage plate spaced from the first carriage plate, the first carriage plate and second carriage plate configured to be secured to the post of the weight rack, and wherein each of the first carriage plate and the second carriage plate comprises a leg portion pivotally engaging the pivoting piece, an arm portion configured to engage the weight rack, and a connecting portion extending from the leg portion outwardly at an angle to the arm portion.

3. The monolift assembly of claim 2, further comprising an arm connecting plate extending between the arm portion of the first carriage plate and the arm portion of the second carriage plate, and a leg connecting plate extending between the leg portion of the first carriage plate and the leg portion of the second carriage plate.

4. The monolift assembly of claim 3, further comprising a first arm pad secured to an interior surface of the arm portion of the first carriage plate, a second arm pad secured to an interior surface of the arm portion of the second carriage plate, an arm connecting plate pad secured to an interior surface of the arm connecting plate, and a leg pad secured to an interior surface of the leg connecting plate.

5. The monolift assembly of claim 2, further comprising a first locking pin extending through a first arm aperture formed in the arm portion of the first carriage plate and a second arm aperture formed in the arm portion of the second carriage plate, and configured to extend through a pair of opposed apertures formed in the post of the weight rack.

6. The monolift assembly of claim 1, wherein the central plate includes a web and a flange extending along a peripheral edge of the web, wherein the flange defines the first recess and the second recess.

7. The monolift assembly of claim 6, wherein the hook includes a notch configured to receive a weightlifting article, and wherein all surfaces defining the notch are formed by the central plate.

8. The monolift assembly of claim 1, further comprising:

a key removably engaging the carriage assembly and extending through a slot in the pivoting piece to prevent rotation of the pivoting piece with respect to the carriage assembly.

9. The monolift assembly of claim 8, wherein the pivoting piece includes an internal magnet adjacent the slot and configured to retain the key within the slot by magnetic force.

10. The monolift assembly of claim 1, wherein the counterweight includes a first weight plate and a second weight plate, the first and second weight plates being connected to and positioned between the first exterior plate and the second exterior plate.

11. The monolift assembly of claim 1, wherein the pivoting piece is pivotally connected to the carriage assembly with a pivot pin.

12. The monolift assembly of claim 1, further comprising a stop pin secured to the carriage assembly proximate the counterweight and configured to engage the pivoting piece to limit a range of movement of the pivoting piece.

13. A monolift assembly comprising:

a carriage assembly including a first carriage plate and a second carriage plate spaced from the first carriage plate, the first carriage plate and second carriage plate configured to be secured to a post of a rack for weightlifting equipment;

a pivoting piece pivotally connected to the carriage assembly with a pivot pin, and including a hook at a first end thereof and a counterweight at a second end thereof, the pivoting piece comprising a central plate having a first recess on a first side and a second recess on a second side opposite the first side, a first exterior plate connected to the first side of the central plate, and a second exterior plate connected to the second side of the central plate, such that a portion of the first exterior plate is received in the first recess and a portion of the second exterior plate is received in the second recess, wherein the pivoting piece further comprises a first weight plate and a second weight plate, the first and second weight plates being positioned between the first exterior plate and the second exterior plate to form the counterweight;

a stop pin secured to the carriage assembly proximate the counterweight and configured to engage the pivoting piece to limit a range of movement of the pivoting piece; and a key removably engaged with the carriage assembly and the pivoting piece to prevent rotation of the pivoting piece with respect to the carriage assembly.

14. The monolift assembly of claim 13, wherein the pivoting piece is mounted between the first carriage plate and the second carriage plate, and the stop pin extends between the first carriage plate and the second carriage plate to engage the pivoting piece.

15. The monolift assembly of claim 14, wherein the pivoting piece has an arcuate slot extending therethrough, and the stop pin extends through the arcuate slot and is configured to travel within the arcuate slot to define the range of movement of the pivoting piece.

16. The monolift assembly of claim 13, wherein the key extends through a slot in the pivoting piece, and the pivoting piece includes an internal magnet adjacent to the slot and configured to retain the key within the slot by magnetic force.

17. A monolift assembly comprising:

a carriage assembly configured to be releasably secured to a post of a weight rack; and a pivoting piece pivotally connected to the carriage assembly, and including a hook at a first end thereof, the pivoting piece comprising a central plate, a first exterior plate abutting a first side of the central plate, and a second exterior plate abutting a second side of the central plate, the pivoting piece further having a counterweight at a second end thereof, the counterweight including a first weight plate positioned between the first exterior plate and the second exterior plate, wherein the central plate, the first exterior plate, and the second exterior plate combine to form the hook, and wherein the first exterior plate, the second exterior plate, and the first weight plate combine to form the counterweight.

18. The monolift assembly of claim 17, wherein the central plate has a first recess on the first side and a second recess on the second side, and wherein a portion of the first exterior plate is received in the first recess and a portion of the second exterior plate is received in the second recess.

19. The monolift assembly of claim 17, wherein the hook includes a notch configured to receive a weightlifting article, and wherein all surfaces defining the notch are formed by the central plate.

20. The monolift assembly of claim 17, wherein the pivoting piece further comprises a second weight plate positioned between the first exterior plate and the second exterior plate, such that the first exterior plate, the second exterior plate, the first weight plate, and the second weight plate combine to form the counterweight.

21. A monolift assembly comprising:

a carriage assembly configured to be releasably secured to a post of a weight rack;

a pivoting piece pivotally connected to the carriage assembly, and including a hook at a first end thereof and a counterweight at a second end thereof, wherein the hook includes a leg extending outward from a central portion of the pivoting piece and a protrusion extending upward from the leg to define a notch; and a roller rotatably mounted on the pivoting piece and configured to rotate about an axis, wherein the roller is positioned within the notch, the roller comprising a barrel portion, a circumferential recess positioned axially forward of the barrel portion and recessed radially inward with respect to the barrel portion, and a circumferential lip positioned axially forward of the circumferential recess and extending radially outward with respect to the circumferential recess, wherein the notch is configured to receive a weightlifting article such that the weightlifting article rests on the roller and sits at least partially within the circumferential recess.

22. The monolift assembly of claim 21, wherein the pivoting piece comprises a central plate, a first exterior plate abutting a first side of the central plate, and a second exterior plate abutting a second side of the central plate, wherein the central plate, the first exterior plate, and the second exterior plate combine to form the hook.

23. The monolift assembly of claim 21, wherein the axis of the roller is generally parallel to the leg and transverse to the protrusion.

24. The monolift assembly of claim 21, wherein the axis of the roller is defined by a bolt extending through the roller, wherein the bolt is connected to the protrusion and the central portion of the pivoting piece.

25. The monolift assembly of claim 21, wherein the roller and the leg have confronting surfaces having complementary mating profile shapes to permit rotation of the roller adjacent to the leg.

26. The monolift assembly of claim 21, wherein the circumferential recess has a smoothly curved contour, and the barrel portion has a cylindrical or frusto-conical shape.

27. The monolift assembly of claim 1, wherein the central plate has a substantially I shaped cross section.

* * * * *